US008591614B2

(12) United States Patent
Ando et al.

(10) Patent No.: US 8,591,614 B2
(45) Date of Patent: Nov. 26, 2013

(54) METHOD OF MANUFACTURING EXHAUST GAS PURIFYING APPARATUS AND EXHAUST GAS PURIFYING APPARATUS

(75) Inventors: Hisashi Ando, Takahama (JP); Takahiko Okabe, Takahama (JP)

(73) Assignee: Ibiden Co., Ltd., Ogaki-shi (JP)

( * ) Notice: Subject to any disclaimer, the term of this patent is extended or adjusted under 35 U.S.C. 154(b) by 29 days.

(21) Appl. No.: 13/352,661

(22) Filed: Jan. 18, 2012

(65) Prior Publication Data

US 2012/0186455 A1 Jul. 26, 2012

(30) Foreign Application Priority Data

Jan. 20, 2011 (JP) ..... 2011-010168

(51) Int. Cl.

| | |
|---|---|
| ***B01D 50/00*** | (2006.01) |
| ***B01D 39/06*** | (2006.01) |
| ***B01D 24/00*** | (2006.01) |
| ***B01D 39/14*** | (2006.01) |

(52) U.S. Cl.

USPC ..... 55/282.3; 55/522; 55/523; 55/524; 422/169; 422/170; 422/171; 422/172; 422/177; 422/178; 422/179; 422/180; 422/181; 422/182

(58) Field of Classification Search

USPC ..... 55/282.3, 522–524; 422/169–172, 422/177–182

See application file for complete search history.

(56) References Cited

U.S. PATENT DOCUMENTS

| | | | | |
|---|---|---|---|---|
| 5,465,573 | A * | 11/1995 | Abe et al. | 60/274 |
| 2007/0266686 | A1 * | 11/2007 | Bruck | 55/523 |
| 2009/0064662 | A1 | 3/2009 | Kontz et al. | |

FOREIGN PATENT DOCUMENTS

| | | |
|---|---|---|
| DE | 88 16 154 U1 | 2/1989 |
| JP | 5-269387 | 10/1993 |

* cited by examiner

*Primary Examiner* — Amber Orlando

(74) *Attorney, Agent, or Firm* — Ditthavong Mori & Steiner, P.C.

(57) ABSTRACT

A method of manufacturing an exhaust gas purifying apparatus includes providing an exhaust gas-treating body. A holding sealing material is provided. The holding sealing material includes inorganic fibers. The holding sealing material has a first end face and a second end face each provided approximately in parallel with a width direction. The holding sealing material is wound around a periphery of the exhaust gas-treating body to form a gap between the first end face and the second end face. The exhaust gas-treating body with the holding sealing material is housed in a casing. At least one of a first electrode member and a first sensor is disposed at the gap of the holding sealing material so that at least one of the first electrode member and the first sensor is connected to the exhaust gas-treating body, passes through the holding sealing material, and penetrates the casing.

16 Claims, 14 Drawing Sheets

C-C line cross-sectional view

A-A line cross-sectional view

B–B line cross-sectional view

METHOD OF MANUFACTURING EXHAUST GAS PURIFYING APPARATUS AND EXHAUST GAS PURIFYING APPARATUS

CROSS-REFERENCE TO RELATED APPLICATIONS

The present application claims priority under 35 U.S.C. §119 to Japanese Patent Application No. 2011-010168, filed on Jan. 20, 2011, the contents of which are incorporated herein by reference in their entirety.

BACKGROUND OF THE INVENTION

1. Field of the Invention

The present invention relates to a method of manufacturing an exhaust gas purifying apparatus, and an exhaust gas purifying apparatus.

2. Discussion of the Background

In order to purify harmful substances such as toxic gases contained in exhaust gas discharged from an internal combustion engine such as an engine, conventionally an exhaust gas purifying apparatus is installed in an exhaust path (exhaust pipe for exhaust gas distribution, and the like) of the internal combustion engine.

The exhaust gas purifying apparatus has a structure in which a casing is provided in the exhaust path of the internal combustion engine, and an exhaust gas-treating body is disposed inside the casing. Examples of the exhaust gas-treating body include a catalyst carrier or a diesel particulate filter (DPF).

For improving the efficiency of purifying harmful substances of the exhaust gas purifying apparatus in which a catalyst is supported on the exhaust gas-treating body, temperatures in the exhaust path of the internal combustion engine and exhaust gas need to be maintained at temperatures suitable for activating the catalyst (hereinafter, also referred to as catalyst activation temperature).

As described earlier, the exhaust gas purifying apparatus in which a catalyst is supported on the exhaust gas-treating body tends not to exert a sufficient catalytic action unless the temperature is raised to a predetermined catalyst activation temperature. Therefore, the exhaust gas purifying apparatus soon after starting the engine problematically requires a certain period of time to achieve a sufficient level of the exhaust gas purification ability.

For solving the problems, electrically heated catalyst (EHC) converters for rapidly heating a catalyst have been proposed to reduce harmful substances discharged immediately after starting the engine.

For example, JP-A 5-269387 discloses a catalytic converter (exhaust gas purifying apparatus) in which a metallic exhaust gas-treating body is provided in a metallic shell (casing), and positive and negative electrode members connected to a metallic catalyst carrier (exhaust gas-treating body) are provided in a manner to insulatingly penetrate the metallic shell wall and project therefrom.

FIG. 1A is a cross-sectional view schematically showing a conventional exhaust gas purifying apparatus disclosed in JP-A 5-269387. FIG. 1B is a C-C line cross-sectional view of the conventional exhaust gas purifying apparatus shown in FIG. 1A.

In a conventional catalytic converter (exhaust gas purifying apparatus) 500 shown in FIG. 1A and FIG. 1B, metallic catalyst carriers (exhaust gas-treating bodies) 530*a*, 530*b*, and 530*c* are disposed in a metallic shell (casing) 520. The outer surfaces of the metallic catalyst carriers 530*a*, 530*b*, and 530*c* are respectively connected to positive electrode members 550*a*, 550*b*, and 550*c*, and further respectively connected to negative electrode members 550*d*, 550*e*, and 550*f*, with another end of each of the positive and negative electrode members penetrating the metallic shell 520.

Moreover, in the conventional catalytic converter 500 shown in FIG. 1A and FIG. 1B, ring-shaped mat members (holding sealing material) 510*a*, 510*b*, and 510*c* are respectively disposed between outer faces of the metallic catalyst carriers 530*a*, 530*b*, and 530*c* and inner faces of the metallic shell 520.

The contents of JP-A 5-269387 are incorporated herein by reference in their entirety.

SUMMARY OF THE INVENTION

According to one aspect of the present invention, a method of manufacturing an exhaust gas purifying apparatus includes providing an exhaust gas-treating body. A holding sealing material is provided. The holding sealing material includes inorganic fibers. The holding sealing material has a mat shape with a length, a width and a thickness. The holding sealing material has a first end face and a second end face each provided approximately in parallel with a width direction. The holding sealing material has the length shorter than a circumferential length of the exhaust gas-treating body. The holding sealing material is wound around a periphery of the exhaust gas-treating body to form a gap between the first end face and the second end face of the holding sealing material. The exhaust gas-treating body with the holding sealing material is housed in a casing so that the holding sealing material is disposed between the exhaust gas-treating body and the casing. At least one of a first electrode member and a first sensor is disposed at the gap of the holding sealing material so that at least one of the first electrode member and the first sensor is connected to the exhaust gas-treating body, passes through the holding sealing material, and penetrates the casing.

According to another aspect of the present invention, an exhaust gas purifying apparatus includes a casing, an exhaust gas-treating body housed in the casing and a holding sealing material. The holding sealing material includes inorganic fibers. The holding sealing material has a mat shape with a length, a width and a thickness. The holding sealing material has a first end face and a second end face each provided approximately in parallel with a width direction of the holding sealing material. The length of the holding sealing material is shorter than a circumferential length of the exhaust gas-treating body. The holding sealing material is wound around the exhaust gas-treating body and disposed between the exhaust gas-treating body and the casing so that the first end face and a second end face of the holding sealing material face each other. A gap is provided between the first end face and the second end face of the holding sealing material. At least one of a first electrode member and a first sensor is disposed at the gap. At least one of the first electrode member and the first sensor is connected to the exhaust gas-treating body, passes through the holding sealing material, and penetrates the casing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1A:
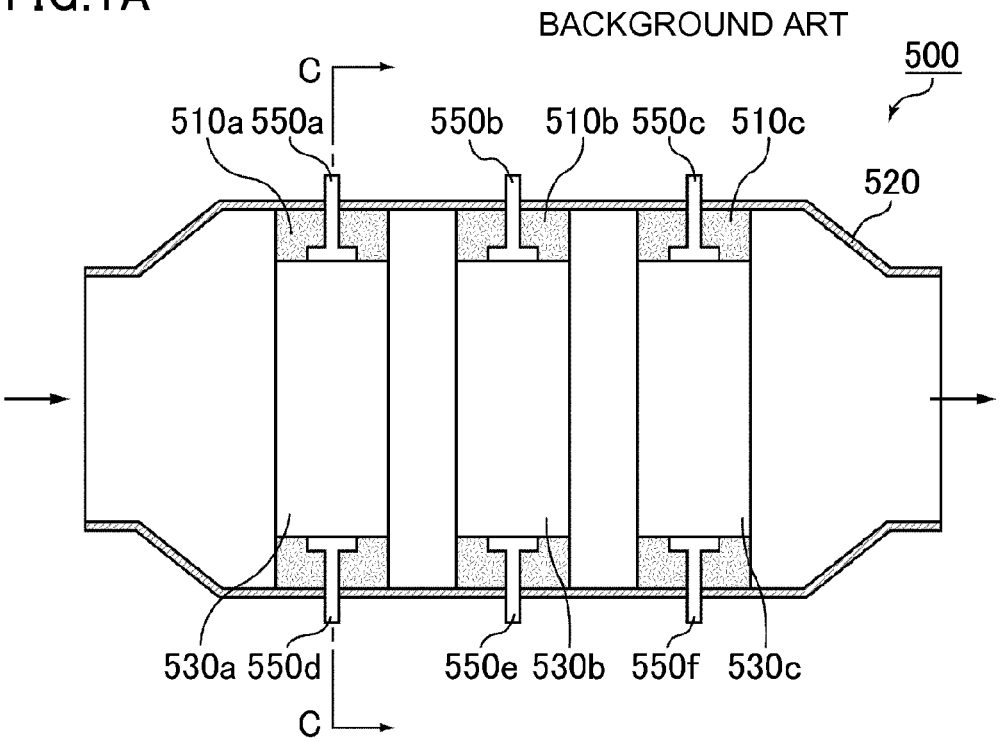
FIG.1A BACKGROUND ART
FIG. 1A is a cross-sectional view schematically showing a conventional exhaust gas purifying apparatus.
Figure 1B:
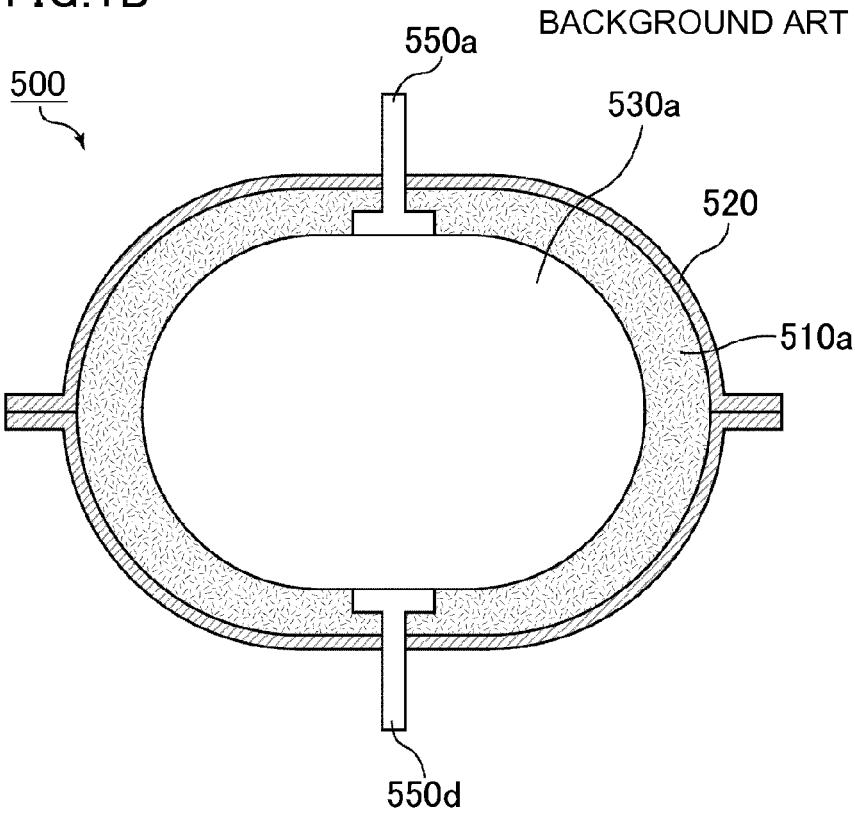
FIG.1B BACKGROUND ART
FIG. 1B is a C-C line cross-sectional view of the conventional exhaust gas purifying apparatus shown in FIG. 1A.

In an electrically heated catalyst converter which is one type of exhaust gas purifying apparatus, an electrode member penetrates a casing, passes through a holding sealing material, and then contacts an exhaust gas-treating body. Further, a sensor for measuring temperatures of the exhaust gas-treating body may penetrate the casing, pass through the holding sealing material, and contact the exhaust gas-treating body.

In the embodiments of the present invention, it is allowed to provide a method of manufacturing an exhaust gas purifying apparatus which makes it easier to dispose at least one of an electrode member and a sensor (hereinafter, the at least one of the electrode member and the sensor may be also referred to as an electrode member or the like), and an exhaust gas purifying apparatus.

In the embodiments of the present invention, if a holding sealing material having a length shorter than the circumferential length of an exhaust gas-treating body is wound around the exhaust gas-treating body, and thereby a gap is formed at the end faces of the holding sealing material, it becomes easier to dispose an electrode member and the like at the gap.

The method of manufacturing a holding sealing material according to the embodiments of the present invention is a method of manufacturing an exhaust gas purifying apparatus, the exhaust gas purifying apparatus including a casing, an exhaust gas-treating body housed in the casing, a holding sealing material wound around the exhaust gas-treating body and disposed between the exhaust gas-treating body and the casing, and at least one of a first electrode member and a first sensor, which is connected to the exhaust gas-treating body, passes through the holding sealing material, and penetrates the casing, wherein the holding sealing material includes inorganic fibers, has a mat shape with predetermined length, width, and thickness, has a first end face and a second end face each provided approximately in parallel with a width direction of the holding sealing material, and has a length shorter than a circumferential length of the exhaust gas-treating body, and the method includes steps of winding the holding sealing material around the periphery of the exhaust gas-treating body to form a gap between the first end face and the second end face of the holding sealing material, and disposing at least one of the first electrode member and the first sensor at the gap of the holding sealing material.

The holding sealing material used in the method of manufacturing an exhaust gas purifying apparatus according to the embodiment of the present invention has a first end face and a second end face each provided approximately in parallel with the width direction of the holding sealing material. The length of the holding sealing material is shorter than the circumferential length of the exhaust gas-treating body.

Therefore, when the holding sealing material is wound around the exhaust gas-treating body, the first end face and the second end face of the holding sealing material do not engage each other. As a result, a gap is formed between the first end face and the second end face of the holding sealing material.

The method of manufacturing an exhaust gas purifying apparatus according to the embodiment of the present invention makes it easier to dispose at least one of an electrode member and a sensor at the gap of the holding sealing material.

In particular, the exhaust gas purifying apparatus in which an electrode member is disposed at the gap of the holding sealing material is likely to be used as an electrically heated catalytic converter.

In the method of manufacturing an exhaust gas purifying apparatus according to the embodiment of the present invention, the length of the holding sealing material in the length direction is preferably from about 50% to about 99.8% of the circumferential length of the exhaust gas-treating body.

In the case that the length of the holding sealing material in the length direction is about 50% or more of the circumferential length of the exhaust gas-treating body, the area of the holding sealing material is less likely to be too small. Therefore, the holding sealing material is likely to hold the exhaust gas-treating body sufficiently. In the case that the length of the holding sealing material in the length direction is about 99.8% or less of the circumferential length of the exhaust gas-treating body, a gap formed between the first end face and the second end face of the holding sealing material becomes less likely to be too small when the holding sealing material is wound around the exhaust gas-treating body. Therefore, it tends not to be difficult to dispose at least one of an electrode member and a sensor at the gap.

In the method of manufacturing an exhaust gas purifying apparatus according the embodiment of the present invention, the distance between the first end face and the second end face of the holding sealing material is preferably from about 1 mm to about 100 mm when the holding sealing material is wound around the exhaust gas-treating body.

In the case that the distance between the first end face and the second end face of the holding sealing material is about 1 mm or more, the gap formed between the first end face and the second end face of the holding sealing material tends not to become too small when the holding sealing material is wound around the exhaust gas-treating body. Therefore, it is less likely to be difficult to dispose at least one of an electrode member and a sensor at the gap. In the case that the distance between the first end face and the second end face of the holding sealing material is about 100 mm or less, the area of the holding sealing material tends not to become too small. Therefore, the holding sealing material is likely to hold the exhaust gas-treating body sufficiently.

In the method of manufacturing an exhaust gas purifying apparatus according to the embodiment of the present invention, each of the first end face and the second end face of the holding sealing material preferably has a step consisting of at least one projected portion.

In the case that each of the first end face and the second end face of the holding sealing material has a step, the projected portions allow easy engagement of the holding sealing material. Therefore, an exhaust gas tends not to leak from the engaged portion of the holding sealing material, and thereby the exhaust gas-sealing property is likely to be maintained. Moreover, in the case that each of the first end face and the second end face of the holding sealing material has a step, the projected portions allow easy engagement of the holding sealing material. Therefore, if force is applied to the exhaust gas purifying apparatus in its width direction, the holding sealing material is less likely to be displaced from the exhaust gas-treating body.

The method of manufacturing an exhaust gas purifying apparatus according to the embodiment of the present invention preferably includes, after the step of winding the holding sealing material, disposing at least one of a second electrode member and a second sensor so as to be connected to the exhaust gas-treating body, to pass through the holding sealing material, and to penetrate the casing. The holding sealing material preferably has a penetration portion penetrating the holding sealing material in the thickness direction. At least one of the second electrode member and the second sensor is preferably disposed at the penetration portion of the holding sealing material.

In this case, at least one of the first electrode member and the first sensor is likely to be disposed at the gap formed between the first end face and the second end face of the holding sealing material, and furthermore, at least one of the second electrode member and the second sensor is likely to be disposed at the penetration portion as well.

The exhaust gas purifying apparatus according to the embodiment of the present invention is characterized by including a casing, an exhaust gas-treating body housed in the casing, a holding sealing material wound around the exhaust gas-treating body and disposed between the exhaust gas-treating body and the casing, and at least one of a first electrode member and a first sensor, which is connected to the exhaust gas-treating body, passes through the holding sealing material, and penetrates the casing, wherein the holding sealing material includes inorganic fibers, has a mat shape with predetermined length, width, and thickness, and has a first end face and a second end face each provided approximately in parallel with the width direction of the holding sealing material, the length of the holding sealing material is shorter than a circumferential length of the exhaust gas-treating body, a gap is formed between the first end face and the second end face of the holding sealing material when the holding sealing material is wound around the exhaust gas-treating body, and at least one of the first electrode member and the first sensor is disposed at the gap of the holding sealing material.

The holding sealing material forming the exhaust gas purifying apparatus according to the embodiment of the present invention has a first end face and a second end face each provided approximately in parallel with the width direction of the holding sealing material. Also, the length of the holding sealing material is shorter than the circumferential length of the exhaust gas-treating body.

For this reason, a gap is formed between the first end face and the second end face of the holding sealing material when the holding sealing material is wound around the exhaust gas-treating body.

The exhaust gas purifying apparatus according to the embodiment of the present invention is characterized by that at least one of an electrode member and a sensor is disposed at the gap of the holding sealing material.

The exhaust gas purifying apparatus in which an electrode member is disposed at the gap, in particular, is likely to be used as an electrically heated catalyst converter.

In the exhaust gas purifying apparatus according to the embodiment of the present invention, the length of the holding sealing material in the length direction is preferably from about 50% to about 99.8% of the circumferential length of the exhaust gas-treating body.

In the case that the length of the holding sealing material in the length direction is about 50% or more of the circumferential length of the exhaust gas-treating body, the area of the holding sealing material does not become too small, and thus the holding sealing material is likely to hold the exhaust gas-treating body sufficiently. In the case that the length of the holding sealing material in the length direction is about 99.8% or less of the circumferential length of the exhaust gas-treating body, a gap formed between the first end face and the second end face of the holding sealing material does not become too small when the holding sealing material is wound around the exhaust gas-treating body. Therefore, it is less likely to be difficult to dispose at least one of an electrode member and a sensor at the gap.

In the exhaust gas purifying apparatus according to the embodiment of the present invention, the distance between the first end face and the second end face of the holding sealing material is preferably from about 1 mm to about 100 mm when the holding sealing material is wound around the exhaust gas-treating body.

In the case that the distance between the first end face and the second end face is about 1 mm or more, the gap formed between the first end face and the second end face of the holding sealing material does not become too small when the holding sealing material is wound around the exhaust gas-treating body. It is thus less likely to be difficult to dispose at least one of an electrode member and a sensor at the gap. In the case that the distance between the first end face and the second end face of the holding sealing material is about 100 mm or less, the area of the holding sealing material does not become too small. Therefore, the holding sealing material is likely to hold the exhaust gas-treating body sufficiently.

In the exhaust gas purifying apparatus according to the embodiment of the present invention, each of the first end face and the second end face of the holding sealing material preferably has a step consisting of at least one projected portion.

In the case that each of the first end face and the second end face of the holding sealing material has a step, the projected portions allow easy engagement of the holding sealing material. Therefore, an exhaust gas tends not to leak from the engaged portion of the holding sealing material, and thereby the exhaust gas-sealing property is likely to be maintained. Moreover, in the case that each of the first end face and the second end face of the holding sealing material has a step, the projected portions allow easy engagement of the holding sealing material. Therefore, if force is applied to the exhaust gas purifying apparatus in its width direction, the holding sealing material is less likely to be displaced from the exhaust gas-treating body.

The exhaust gas purifying apparatus according to the embodiment of the present invention preferably further includes at least one of a second electrode member and a second sensor which is connected to the exhaust gas-treating body, passes through the holding sealing material, and penetrates the casing. And the holding sealing material preferably has a penetration portion penetrating the holding sealing material in the thickness direction, and at least one of the second electrode member and the second sensor is preferably disposed at the penetration portion of the holding sealing material.

In the aforementioned exhaust gas purifying apparatus, at least one of the first electrode member and the first sensor is likely to be disposed at the gap formed between the first end face and the second end face of the holding sealing material, and furthermore, at least one of the second electrode member and the second sensor is likely to be disposed at the penetration portion as well.

The embodiments will now be described with reference to the accompanying drawings, wherein like reference numerals designate corresponding or identical elements throughout the various drawings. The present invention is not limited to embodiments below and can be appropriately applicable to other embodiments in the scope that does not change the gist of the present invention.

First Embodiment

Referring to the drawings, the following will describe the first embodiment that is one of the embodiments of the method of manufacturing an exhaust gas purifying apparatus, and the exhaust gas purifying apparatus according to the present invention.

First, an exhaust gas purifying apparatus according to the first embodiment of the present invention will be described.

Figure 2A:
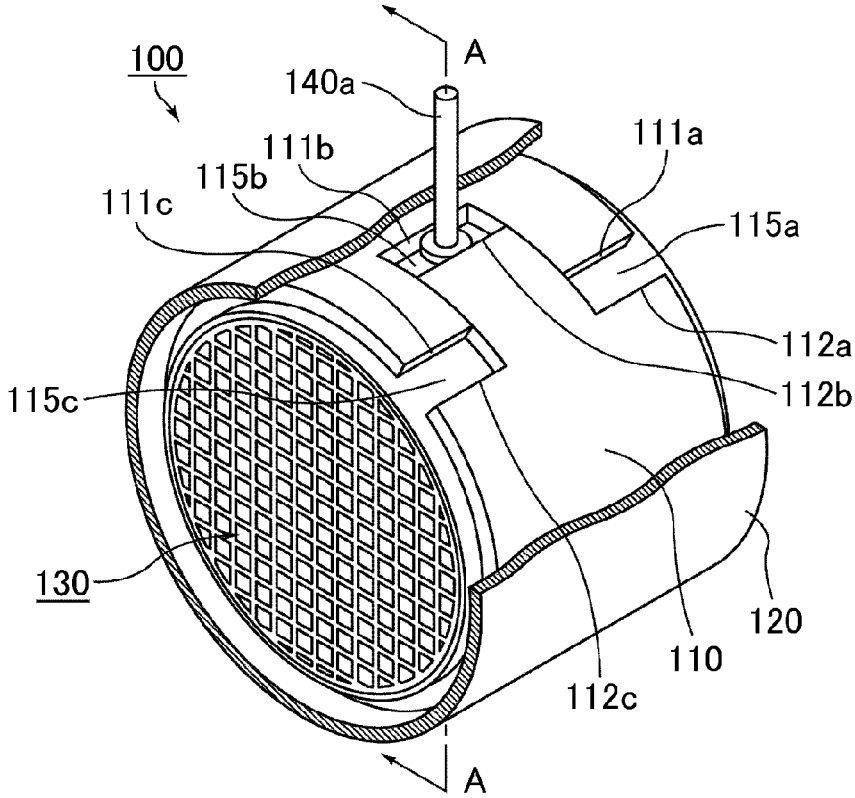
FIG. 2A is a perspective cross-sectional cutaway view schematically showing an example of an exhaust gas purifying apparatus according to the first embodiment of the present invention.
Figure 2B:
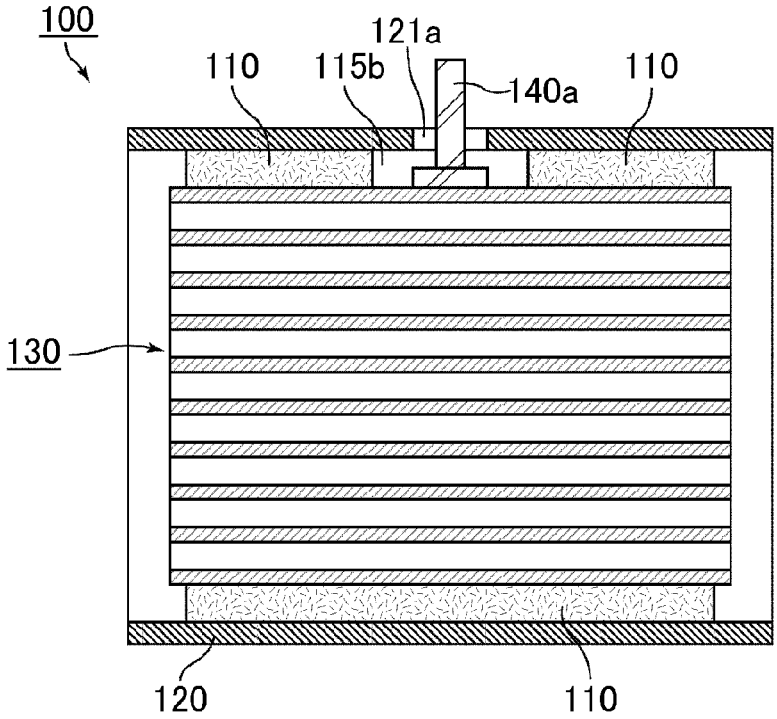
FIG. 2B is an A-A line cross-sectional view of the exhaust gas purifying apparatus shown in FIG. 2A.

FIG. 2A is a perspective cross-sectional cutaway view schematically showing an example of an exhaust gas purifying apparatus according to the first embodiment of the present invention. FIG. 2B is an A-A line cross-sectional view of the exhaust gas purifying apparatus shown in FIG. 2A.

An exhaust gas purifying apparatus 100 shown in FIG. 2A and FIG. 2B includes a casing 120, an exhaust gas-treating body 130 housed in the casing 120, and a holding sealing material 110 disposed between the exhaust gas-treating body 130 and the casing 120.

The exhaust gas purifying apparatus 100 further includes a sensor 140*a* which is connected to the exhaust gas-treating body 130, passes through the holding sealing material 110, and penetrates the casing 120.

The holding sealing material 110 is wound around the exhaust gas-treating body 130. The exhaust gas-treating body 130 is held by the holding sealing material 110.

An inlet pipe for introducing exhaust gas discharged from the internal combustion engine and an exhaust pipe for discharging the exhaust gas having passed through the exhaust gas-treating body to the outside are connected to an end of the casing 120, if necessary.

The following description will discuss the exhaust gas-treating body forming the exhaust gas purifying apparatus of the present embodiment.

Figure 3:
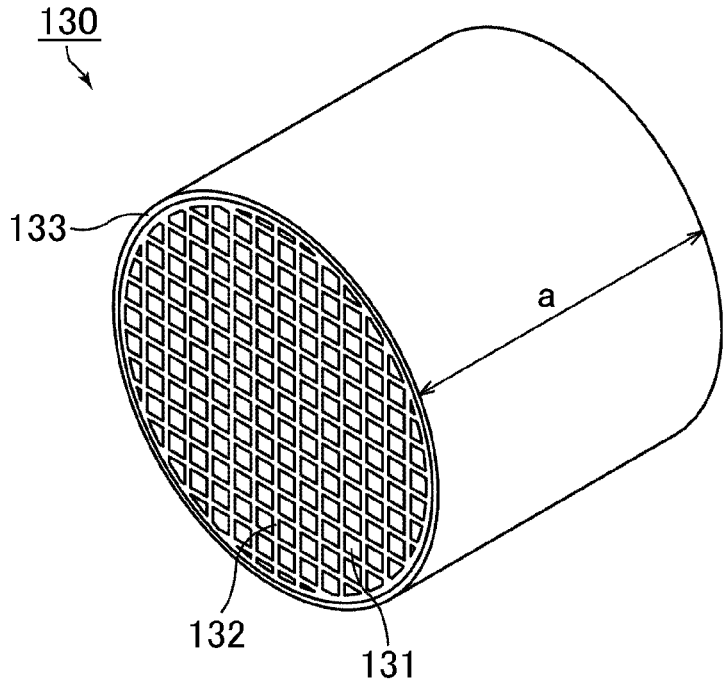
FIG. 3 is a perspective view schematically showing an example of an exhaust gas-treating body forming the exhaust gas purifying apparatus according to the first embodiment of the present invention.

FIG. 3 is a perspective view schematically showing an example of an exhaust gas-treating body forming the exhaust gas purifying apparatus according to the first embodiment of the present invention.

FIG. 3 illustrates a catalyst carrier as an example of the exhaust gas-treating body.

The exhaust gas-treating body 130 shown in FIG. 3 mainly includes a porous ceramic material and has an approximately round pillar-shape. Moreover, a coat layer 133 is formed on the outer periphery of the exhaust gas-treating body 130 so as to reinforce the outer peripheral portion of the exhaust gas-treating body 130, to adjust the shape, and to improve the heat insulating property of the exhaust gas-treating body 130. The coat layer may be formed, if necessary.

The exhaust gas-treating body 130 shown in FIG. 3 is a honeycomb structured body in which a large number of through holes 131 are placed in parallel with one another in the longitudinal direction (in FIG. 3, a direction indicated by a double-headed arrow "a"), with a separation wall 132 interposed therebetween.

In the exhaust gas-treating body 130, a catalyst for converting toxic gas components such as CO, HC, and NOx contained in exhaust gas is supported on the separation wall 132 of the honeycomb structured body. Examples of the catalyst include platinum.

The holding sealing material forming the exhaust gas purifying apparatus according to the present embodiment is described.

Figure 4:
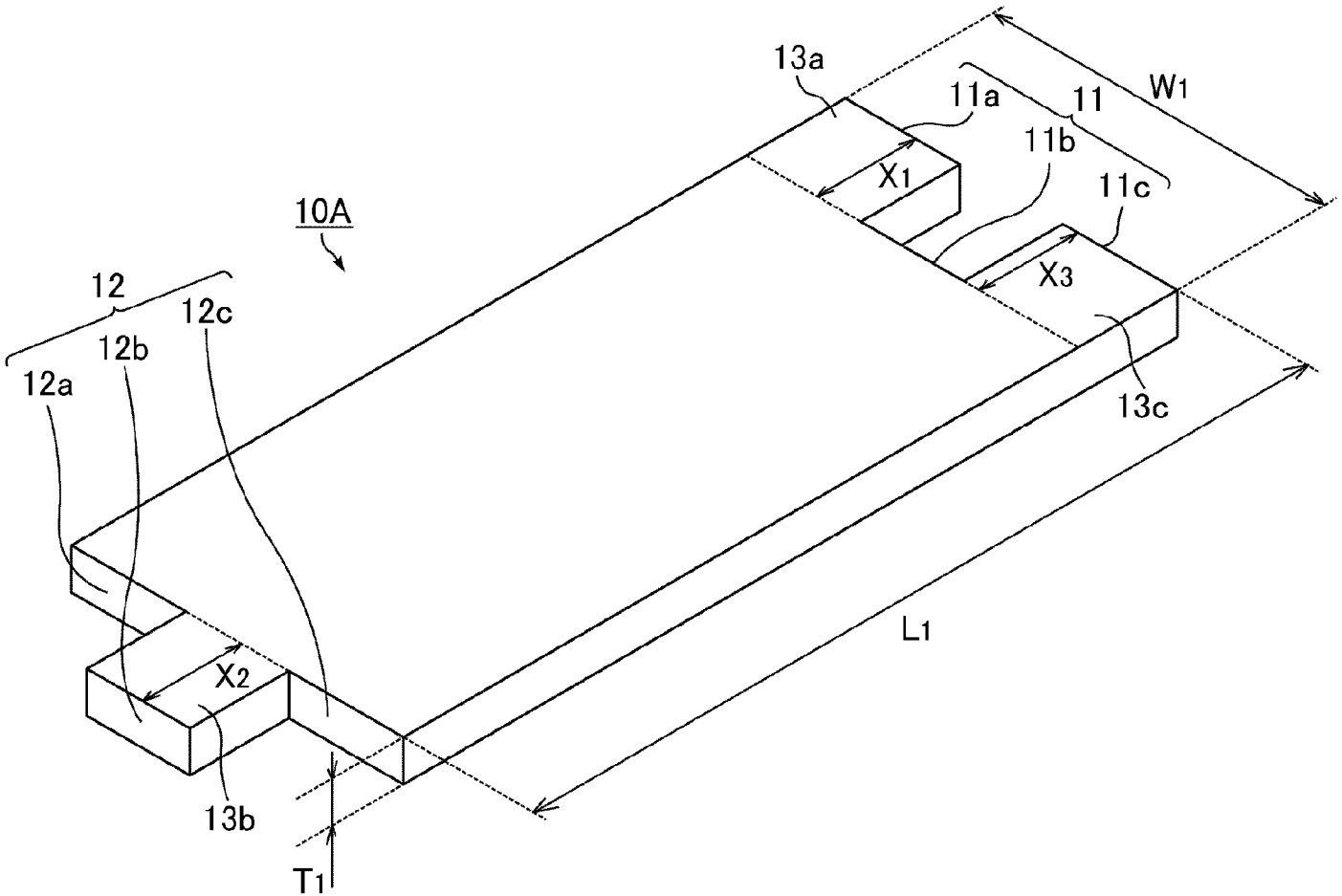
FIG. 4 is a perspective view schematically showing an example of a holding sealing material forming the exhaust gas purifying apparatus according to the first embodiment of the present invention.

FIG. 4 is a perspective view schematically showing an example of the holding sealing material forming the exhaust gas purifying apparatus according to the first embodiment of the present invention.

A holding sealing material 10A illustrated in FIG. 4 includes inorganic fibers such as alumina-silica fibers and has a mat shape. More specifically, the holding sealing material 10A has an approximately rectangular plate-like shape in a plain view having a predetermined length (shown by an arrow $L_1$ in FIG. 4), a predetermined width (shown by an arrow $W_1$ in FIG. 4), and a predetermined thickness (shown by an arrow $T_1$ in FIG. 4). Moreover, the holding sealing material 10A has a first end face 11 (11*a*, 11*b*, and 11*c*) and a second end face 12 (12*a*, 12*b*, and 12*c*) which are approximately parallel in the width $W_1$ direction of the holding sealing material 10A.

Meanwhile, the term "the length of the holding sealing material in a length direction" used herein refers to the distance between the first end face and the second end face in the length direction of the holding sealing material. Moreover, "the length of the holding sealing material in a length direction" is also simply called "the length of the holding sealing material."

In the holding sealing material forming the exhaust gas purifying apparatus of the present embodiment, each of the first end face and the second end face has a step formed by at least one projected portion.

In the holding sealing material 10A shown in FIG. 4, two projected portions 13*a* and 13*c* are formed at the first end face 11, and one projected portion 13*b* is formed at the second end face 12. When the first end face 11 of the holding sealing material 10A is made in contact with the second end face 12 of the holding sealing material 10A, a convex formed by the projected portion 13*b* tends to engage with a concave formed by the projected portion 13*a* and the projected portion 13*c*.

As mentioned earlier, in the holding sealing material 10A illustrated in FIG. 4, each of the first end face 11 and the second end face 12 has three levels of steps.

Figure 5:
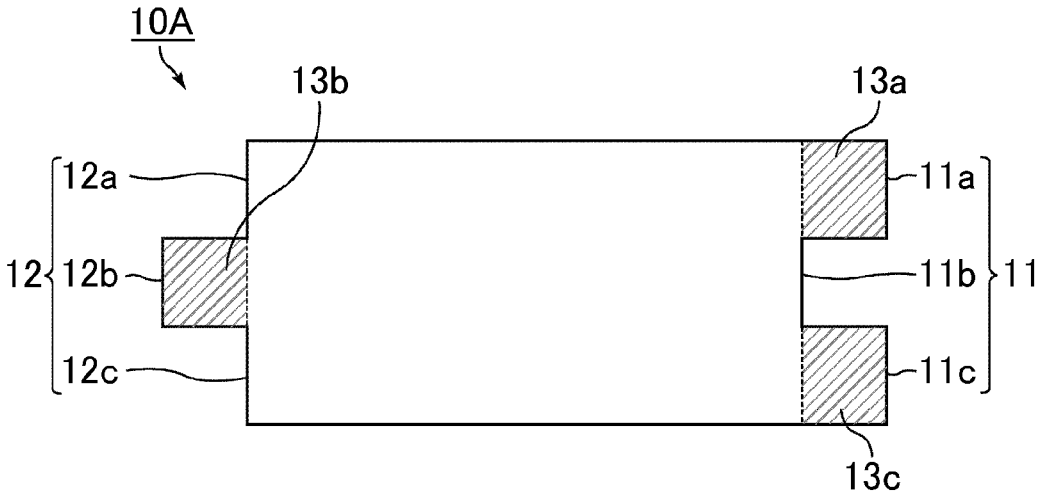
FIG. 5 is a plain view of the holding sealing material shown in FIG. 4.

FIG. 5 is a plain view of the holding sealing material shown in FIG. 4.

FIG. 5 shows specific positions of the projected portions 13*a*, 13*b*, and 13*c* formed in the holding sealing material 10A.

As used herein, the term "projected portion" refers to the following region.

Namely, the "projected portion" refers to a portion of the holding sealing material between an end face including the start point of a step and an end face including the end point of the step in the end faces (first end face or second end face) of the holding sealing material. Therefore, the projected portion of the holding sealing material exists at both of the first end face side and the second end face side of the holding sealing material.

In the holding sealing material forming the exhaust gas purifying apparatus according to the present embodiment, the lengths of the projected portions are approximately the same in the length direction of the holding sealing material. As a result, the distance between the first end face and the second end face is approximately the same at any part of the holding sealing material.

Hereinafter, in the holding sealing material 10A shown in FIG. 4, the length of the projected portion 13*a* (shown by an arrow $X_1$ in FIG. 4), the length of the projected portion 13*b* (shown by an arrow $X_2$ in FIG. 4), and the length of the projected portion 13*c* (shown by an arrow $X_3$ in FIG. 4) in the length $L_1$ direction of the holding sealing material 10A are approximately the same from one another. Therefore, the holding sealing material 10A shown in FIG. 4 has an approximately fixed length $L_1$.

The term "approximately the same" allows not-exactly the same length, and includes such length as being considered substantially the same.

In the exhaust gas purifying apparatus according to the present embodiment, the holding sealing material having a length shorter than the circumferential length of the exhaust gas-treating body forming the exhaust gas purifying apparatus is used.

Thus, a gap is formed between the first end face and the second end face of the holding sealing material when the holding sealing material is wound around the exhaust gas-treating body.

In an exhaust gas purifying apparatus 100 shown in FIG. 2A and FIG. 2B, the holding searing material 10A shown in FIG. 4 is used as an example of the holding sealing material 110.

As shown in FIG. 2A and FIG. 2B, a gap 115*a*, a gap 115*b*, and a gap 115*c* are formed between the first end face 111*a* and the second end face 112*a*, between the first end face 111*b* and the second end face 112*b*, and between the first end face 111*c* and the second end face 112*c*, respectively, of the holding sealing material 110 wound around the exhaust gas-treating body 130. Moreover, in the exhaust gas purifying apparatus 100 shown in FIG. 2A and FIG. 2B, a sensor 140*a* is disposed at the gap 115*b*.

In the exhaust gas purifying apparatus according to the present embodiment, the length of the holding sealing material in the length direction is preferably from about 50% to about 99.8% of the circumferential length of the exhaust gas-treating body.

In the case that the length of the holding sealing material in the length direction is about 50% or more of the circumferential length of the exhaust gas-treating body, the area of the holding sealing material tends not to be too small. Therefore, the holding sealing material is likely to hold the exhaust gas-treating body sufficiently. In the case that the length of the holding sealing material in the length direction is about 99.8% or less of the circumferential length of the exhaust gas-treating body, a gap formed between the first end face and the second end face of the holding sealing material tends not to become too small when the holding sealing material is wound around the exhaust gas-treating body. Therefore, it becomes less likely to be difficult to dispose at least one of an electrode member and a sensor at the gap.

In the exhaust gas purifying apparatus of the present embodiment, the distance between the first end face and the second end face of the holding sealing material when the holding sealing material is wound around the exhaust gas-treating body is preferably from about 1 mm to about 100 mm, and more preferably from about 20 mm to about 40 mm.

In the case that the distance between the first end face and the second end face of the holding sealing material is about 1 mm or more, the gap formed between the first end face and the second end face of the holding sealing material when the holding sealing material is wound around the exhaust gas-treating body does not become too small. Therefore, it tends not to become difficult to dispose at least one of an electrode member and a sensor at the gap. In the case that the distance between the first end face and the second end face of the holding sealing material is about 100 mm or less, the area of the holding sealing material does not become too small. Therefore, the holding sealing material is likely to hold the exhaust gas-treating body sufficiently.

As used herein, the distance between the first end face and the second end face of the holding sealing material when the holding sealing material is wound around the exhaust gas-treating body refer not to the length of the holding sealing material but to the size of the gap, namely, the distance between the first end face and the second end face which are facing one another.

The holding sealing material forming the exhaust gas purifying apparatus of the present embodiment may include a binder such as an organic binder. The binder included in the holding sealing material is likely to bond the inorganic fibers forming the holding sealing material to one another. Therefore, it becomes easier to reduce the volume of the holding sealing material upon stuffing the holding sealing material into the casing, or to prevent the inorganic fibers from scattering.

The holding sealing material forming the exhaust gas purifying apparatus of the present embodiment may be a needle mat obtained by carrying out a needling treatment on a base mat including inorganic fibers.

The needling treatment refers to a treatment in which needles or the like serving as a fiber entangling means are inserting and withdrawing to and from the base mat. In the holding sealing material subjected to the needling treatment, inorganic fibers having a comparatively long fiber length are more easily three-dimensionally entangled with one another. As a result, the strength of the needle mat is likely to be enhanced.

The holding sealing material forming the exhaust gas purifying apparatus of the present embodiment can be manufactured, for example, by punching the base mat prepared by entangling the inorganic fibers with one another by a spinning method in a desired shape.

The following description will discuss the casing forming the exhaust gas purifying apparatus of the present embodiment.

Figure 6:
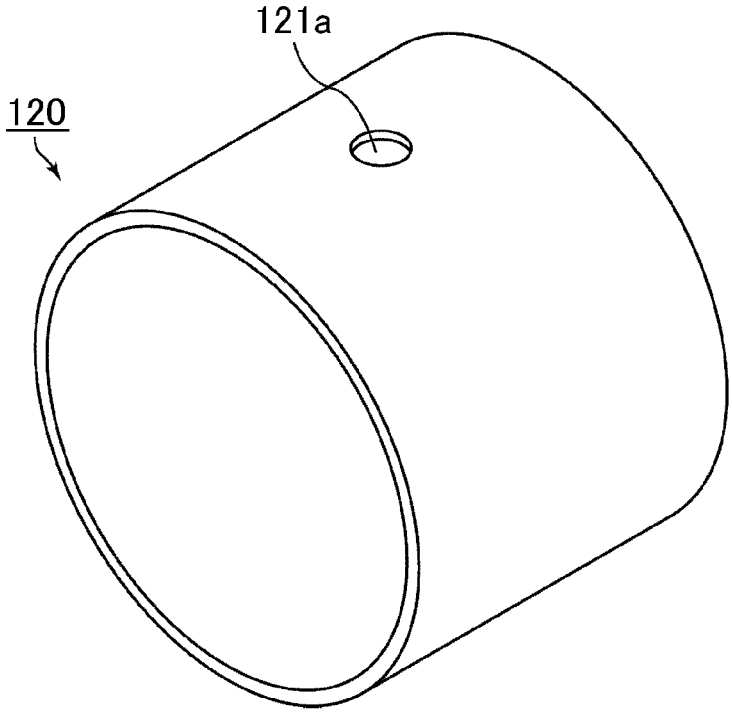
FIG. 6 is a perspective view schematically showing an example of a casing forming the exhaust gas purifying apparatus according to the first embodiment of the present invention.

FIG. 6 is a perspective view schematically showing an example of a casing forming the exhaust gas purifying apparatus according to the first embodiment of the present invention. The casing 120 shown in FIG. 6 is mainly made of metal such as stainless steel, and has an approximately cylindrical shape. The casing 120 has a hole 121*a* for allowing a sensor to penetrate therein.

The inner diameter of the casing 120 is made slightly shorter than a sum of the diameter of an end face of the exhaust gas-treating body 130 shown in FIG. 3 and the thickness of the holding sealing material wound around the exhaust gas-treating body 130.

Meanwhile, the length of the casing may be slightly longer than the longitudinal direction length of the exhaust gas-treating body and may approximately the same with the longitudinal direction length of the exhaust gas-treating body.

In the exhaust gas purifying apparatus 100 illustrated in FIG. 2A and FIG. 2B, the position of the gap 115*b* in the holding sealing material 110 corresponds with the position of the hole 121*a* of the casing 120. The sensor 140*a* is disposed at the gap 115*b* in the holding sealing material 110 and in the hole 121*a* of the casing 120.

The following description will discuss a sensor which forms the exhaust gas purifying apparatus of the present embodiment.

The kinds of the sensor in the exhaust gas purifying apparatus of the present embodiment are not particularly limited. Examples of the sensor include a temperature sensor for measuring the temperature of the exhaust gas purifying apparatus or the atmosphere, and an oxygen sensor.

The sensor may be used singly or in combination with a plurality of sensors as long as the sensor is disposed at the gap between the first end face and the second end face of the holding sealing material.

The following description will discuss the method of manufacturing an exhaust gas purifying apparatus according to the first embodiment of the present invention with reference to the drawings.

FIG. 7A, FIG. 7B, FIG. 7C, and FIG. 7D each are a perspective view schematically showing an example of a method of manufacturing the exhaust gas purifying apparatus according to the first embodiment of the present invention.

FIG. 7A, FIG. 7B, FIG. 7C, and FIG. 7D illustrate a method of manufacturing the exhaust gas purifying apparatus 100 shown in FIG. 2A and FIG. 2B as an example of the method of manufacturing the exhaust gas purifying apparatus according to the first embodiment of the present invention.

Figure 7A:
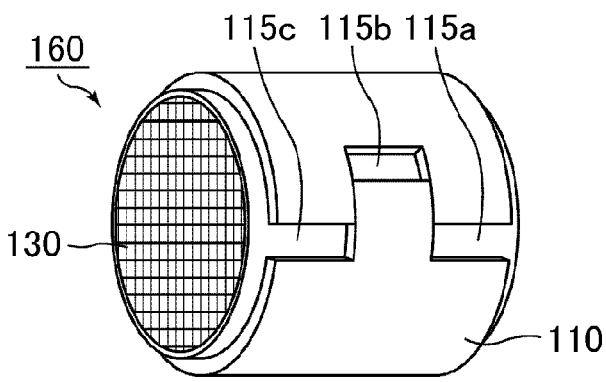
FIG. 7A, FIG. 7B, FIG. 7C, and FIG. 7D each are a perspective view schematically showing an example of a method of manufacturing an exhaust gas purifying apparatus according to the first embodiment of the present invention.

First, as shown in FIG. 7A, a winding step is performed by winding the holding sealing material 110 around the exhaust gas-treating body 130 to manufacture a wound body (exhaust gas-treating body with the holding sealing material wound therearound) 160.

The holding sealing material 10A shown in FIG. 4 is used as the holding sealing material 110. In this case, the length of the holding sealing material 110 is shorter than the circumferential length of the exhaust gas-treating body 130. Therefore, the gap 115*a*, the gap 115*b*, and the gap 115*c* are formed between the first end face and the second end face of the holding sealing material 110.

Figure 7B:
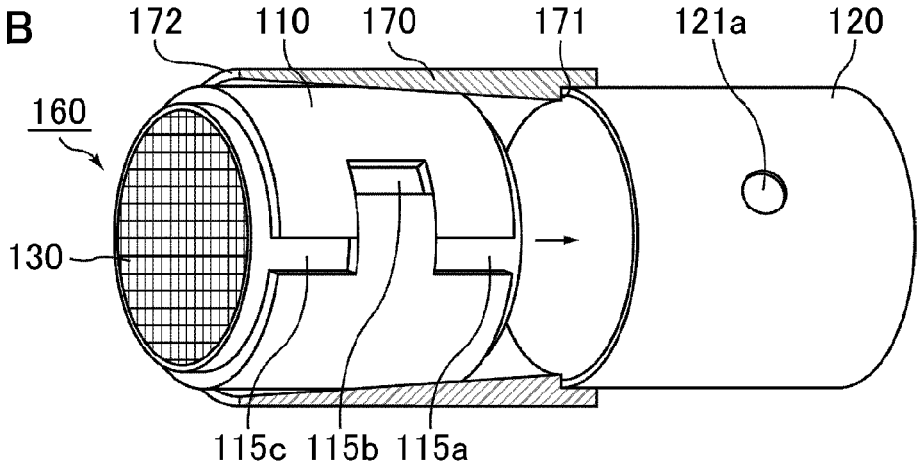

Next, as shown in FIG. 7B, a housing step is performed by housing the manufactured wound body 160 in the casing 120 having an approximately cylindrical shape.

Examples of the method for housing the wound body in the casing include a stuffing method (press-fitting method), a sizing method (swaging method), and a clam shell method.

In a stuffing method, the wound body is stuffed with a jig for stuffing and the like into a predetermined position in the casing. In a sizing method (swaging method), the wound body is inserted in the casing and is then compressed by applying pressures from the outer periphery side so as to reduce the inner diameter of the casing. In a clam shell method, the casing is made separable into two parts of a first casing and a second casing. The wound body is placed on the first casing and covered with the second casing to be sealed.

The stuffing method or sizing method (swaging method) is preferable among the methods for housing the wound body in the casing. This is because the stuffing method or sizing method (swaging methods) does not require two parts as casing, and therefore the number of manufacturing process is likely to be reduced.

FIG. 7B illustrates a method for stuffing the wound body 160 into the casing 120 by using a stuffing jig 170.

The stuffing jig 170 has an approximately cylindrical shape as a whole, with its inside being expanded from one end to the other end in a tapered state.

One end of the stuffing jig 170 forms an end on a shorter diameter side 171 having an inner diameter corresponding to a diameter slightly smaller than the inner diameter of the casing 120. Moreover, the other end of the stuffing jig 170 forms an end on a longer diameter side 172 having at least an inner diameter corresponding to the outer diameter of the wound body 160.

By using the stuffing jig 170, the wound body 160 is likely to be easily stuffed into the casing 120.

Meanwhile, the method for stuffing the wound body into the casing is not particularly limited, and, for example, a method may be used in which the wound body is stuffed into the casing by pushing the wound body with the hand.

Figure 7C:
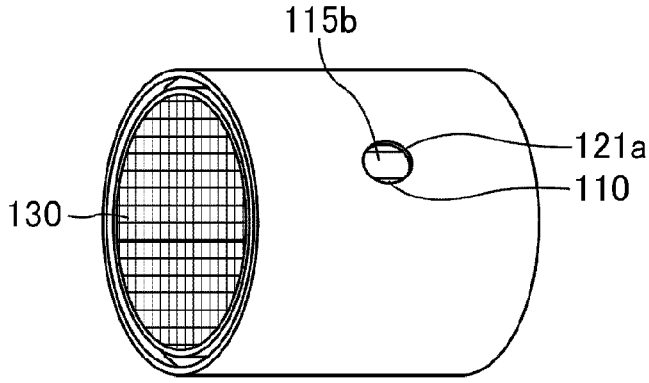

Next, as shown in FIG. 7C, position adjustment step is performed by adjusting the position of the gap 115*b* formed between the first end face and the second end face of the holding sealing material 110 to the position of the hole 121*a* of the casing 120.

Examples of the method for adjusting the position of the gap to the position of the hole of the casing include a method including rotation of the wound body housed in the casing.

In the above housing step, in the case of housing the wound body in the casing while adjusting the position of the gap to match the position of the hole of the casing, the housing step and the position adjustment step are likely to be simultaneously performed.

Subsequently, a disposing step (first disposing step) is performed to dispose a sensor such that the sensor is connected to the exhaust gas-treating body, passes through the holding sealing material, and penetrates the casing.

Figure 7D:
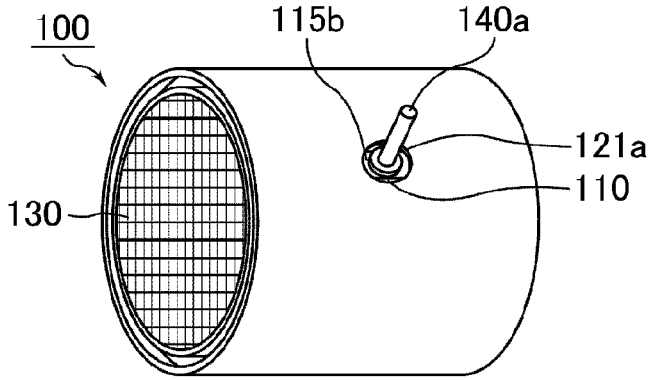

As shown in FIG. 7D, in the disposing step (first disposing step), the sensor 140*a* such as a temperature sensor is passed through the gap 115*b* formed between the first end face and the second end face in the holding sealing material 110 and the hole 121*a* of the casing 120 so that the sensor 140*a* is connected to the exhaust gas-treating body 130.

The exhaust gas purifying apparatus 100 shown in FIG. 2A and FIG. 2B can be manufactured through the above process.

In the above method of manufacturing an exhaust gas purifying apparatus according to the present embodiment, the sensor is disposed at the gap and the hole of the casing after housing the wound body in the casing.

However, in the case that a clam shell method is applied in the method of manufacturing an exhaust gas purifying apparatus according to the present embodiment, the wound body may be housed in the casing in a following manner. Namely, the wound body is placed on the first casing, and the sensor is disposed at the gap, and then the second casing is covered thereon so that the sensor is allowed to pass through the hole formed in the second casing.

Moreover, in the method of manufacturing an exhaust gas purifying apparatus according to the present embodiment, if a clam shell method is applied, a sensor-attached wound body may be manufactured by firstly fixing the sensor at a predetermined position of the exhaust gas-treating body, and then winding the holding sealing material around the exhaust gas-treating body such that the sensor remains uncovered. In this case, after placing the sensor-attached wound body on the first casing, the wound body is covered with the second casing in a manner that the sensor passes through the hole formed in the second casing. Accordingly, the wound body is housed in the casing.

The following description will list the effects obtained by the method of manufacturing an exhaust gas purifying apparatus, and the exhaust gas purifying apparatus of the present embodiment.

(1) In the method of manufacturing an exhaust gas purifying apparatus, and the exhaust gas purifying apparatus of the present embodiment, the holding sealing material having a length shorter than the circumferential length of the exhaust gas-treating body is used.

Since the length of the holding sealing material is shorter than the circumferential length of the exhaust gas-treating body, the first end face and the second end face do not engage each other when the holding sealing material is wound around the gas-treating body. As a result, a gap is formed between the first end face and the second end face of the holding sealing material.

In the method of manufacturing an exhaust gas purifying apparatus, and the exhaust gas purifying apparatus of the present embodiment, a sensor is likely to be disposed at the gap of the holding sealing material.

(2) In the method of manufacturing an exhaust gas purifying apparatus, and the exhaust gas purifying apparatus of the present embodiment, a sensor is likely to be disposed even if a through hole is not formed in the holding sealing material. Therefore, punching processing or the like for forming a through hole in the holding sealing material tends to be not necessary in manufacturing the holding sealing material.

(3) If a through hole is formed in the holding sealing material, the area of the holding sealing material decreases. Thereby, the holding power and the tensile strength of the holding sealing material tend to deteriorate. As a result, upon pulling the holding sealing material for assembly into the exhaust gas-treating body, problems tend to arise such as damage of the holding sealing material, defective assembly including overlapping.

However, since a sensor is likely to be disposed at the gap of the holding sealing material in the method of manufacturing an exhaust gas purifying apparatus, and the exhaust gas purifying apparatus of the present embodiment, the above problems are likely to be prevented from occurring.

Meanwhile, the phrase "overlapping" used herein refers to a condition that the holding sealing material having a through hole formed therein is extended upon being pulled to assemble the holding sealing material into the exhaust gas-treating body so that the holding sealing material is excessively wound.

(4) In the method of manufacturing an exhaust gas purifying apparatus, and the exhaust gas purifying apparatus of the present embodiment, each of the first end face and the second end face of the holding sealing material is provided with a step formed by at least one projected portion.

In the case that each of the first end face and the second end face of the holding sealing material has a step, the projected portions allow easy engagement of the holding sealing material. Therefore, an exhaust gas tends not to leak from the engaged portion of the holding sealing material, and thereby the exhaust gas-sealing property is likely to be maintained. Moreover, in the case that each of the first end face and the second end face of the holding sealing material has a step, the projected portions allow easy engagement of the holding sealing material. Therefore, if force is applied to the exhaust gas purifying apparatus in its width direction, the holding sealing material is less likely to be displaced from the exhaust gas-treating body.

Second Embodiment

The following will describe the second embodiment which is one of the embodiments of the present invention.

The method of manufacturing an exhaust gas purifying apparatus, and the exhaust gas purifying apparatus according to the second embodiment of the present invention are different from the method of manufacturing an exhaust gas purifying apparatus, and the exhaust gas purifying apparatus, respectively, according to the first embodiment of the present invention, in that a penetration portion penetrating the holding sealing material in the thickness direction forming the exhaust gas purifying apparatus is formed in the former method and apparatus.

An exhaust gas purifying apparatus according to the second embodiment of the present invention will be described.

Figure 8A:
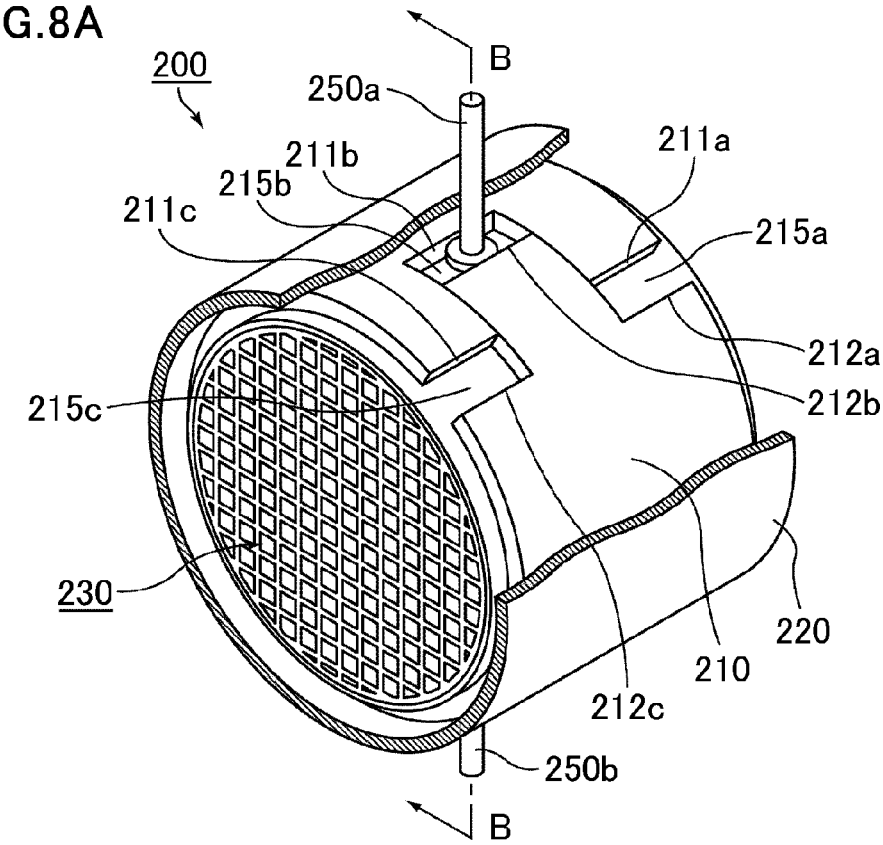
FIG. 8A is a perspective cross-sectional cutaway view schematically showing an example of an exhaust gas purifying apparatus according to the second embodiment of the present invention.
Figure 8B:
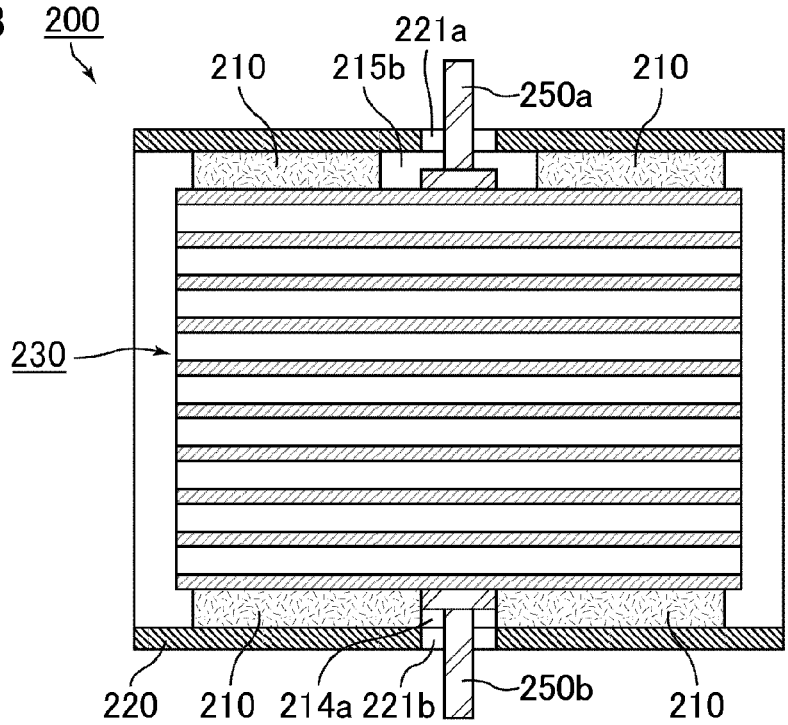
FIG. 8B is a B-B line cross-sectional view of the exhaust gas purifying apparatus shown in FIG. 8A.

FIG. 8A is a perspective cross-sectional cutaway view schematically showing an example of an exhaust gas purifying apparatus according to the second embodiment of the present invention. FIG. 8B is a B-B line cross-sectional view of the exhaust gas purifying apparatus shown in FIG. 8A.

An exhaust gas purifying apparatus 200 shown in FIG. 8A and FIG. 8B includes a casing 220, an exhaust gas-treating body 230 housed in the casing 220, and a holding sealing material 210 disposed between the exhaust gas-treating body 230 and the casing 220.

The exhaust gas purifying apparatus 200 further includes electrode members 250*a* and 250*b* which are connected to the exhaust gas-treating body 230, pass through the holding sealing material 210 and penetrate the casing 220. The electrode member 250*a* is an electrode member on the positive side and the electrode member 250*b* is an electrode member on the negative side.

The holding sealing material 210 is wound around the exhaust gas-treating body 230. The exhaust gas-treating body 230 is held by the holding sealing material 210.

An inlet pipe for introducing exhaust gas discharged from the internal combustion engine and an exhaust pipe for discharging the exhaust gas having passed through the exhaust gas-treating body to the outside are connected to ends of the casing 220, if necessary.

The exhaust gas purifying apparatus of the present embodiment is likely to be used as an electrically heated catalyst converter.

In the exhaust gas purifying apparatus 200 shown in FIG. 8A and FIG. 8B, application of a predetermined voltage between the positive-side electrode member 250*a* and the negative-side electrode member 250*b* powers the exhaust gas-treating body 230 existing between the positive-side electrode member 250*a* and the negative-side electrode member 250*b*. As a result, the exhaust gas-treating body 230 generates heat.

The generated heat heats a catalyst supported on the exhaust gas-treating body 230 so that the catalyst is activated. As a result, oxidation and reduction reactions of toxic gas components such as CO, HC, and NOx contained in the exhaust gas proceed, converting the toxic gas components.

The following description will discuss the holding sealing material forming the exhaust gas purifying apparatus of the present embodiment.

The holding sealing material forming the exhaust gas purifying apparatus of the present embodiment has a structure of the holding sealing material forming the exhaust gas purifying apparatus according to the first embodiment of the present invention in which a penetration portion is formed in the holding sealing material.

Figure 9:
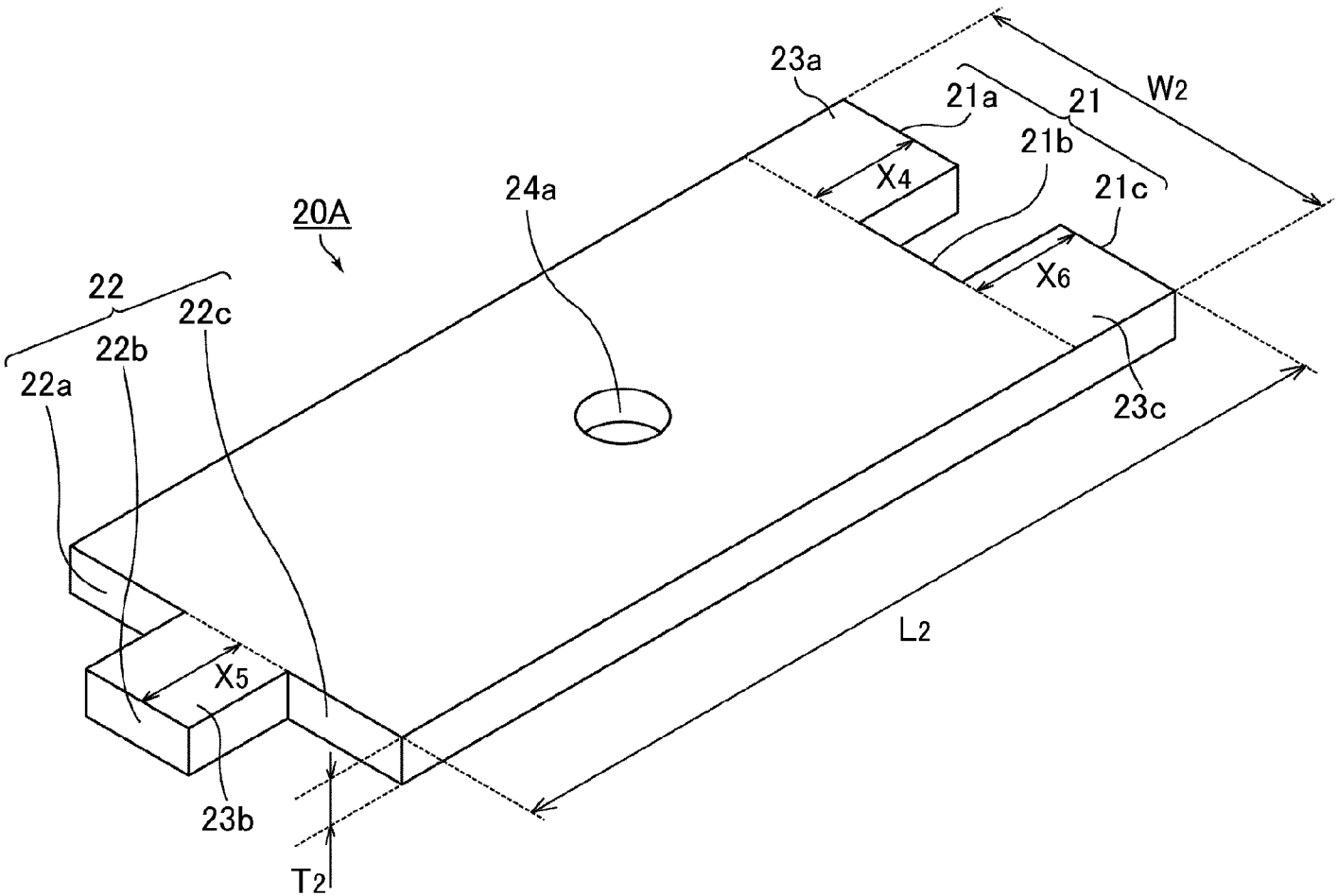
FIG. 9 is a perspective view schematically showing an example of the holding sealing material forming the exhaust gas purifying apparatus according to the second embodiment of the present invention.

FIG. 9 is a perspective view schematically showing an example of the holding sealing material forming the exhaust gas purifying apparatus according to the second embodiment of the present invention.

A holding sealing material 20A shown in FIG. 9 has a structure similar to that of the holding sealing material 10A that is one example of the holding sealing material forming the exhaust gas purifying apparatus according to the first embodiment of the present invention shown in FIG. 4, except that a penetration portion 24*a* is formed.

The holding sealing material 20A illustrated in FIG. 9 includes inorganic fibers such as alumina-silica fibers and has a mat shape. More specifically, the holding sealing material 20A has a plain plate shape with an approximately rectangular shape in a plain view having a predetermined length (shown by an arrow $L_2$ in FIG. 9), a predetermined width (shown by an arrow $W_2$ in FIG. 9), and a predetermined thickness (shown by an arrow $T_2$ in FIG. 9). Moreover, the holding sealing material 20A has first end face 21 (21*a*, 21*b*, and 21*c*) and second end face 22 (22*a*, 22*b*, and 22*c*) which are approximately parallel in the width $W_2$ direction of the holding sealing material 20A. Moreover, the holding sealing material 20A has the penetration portion 24*a*.

In the holding sealing material forming the exhaust gas purifying apparatus of the present embodiment, each of the first end face and the second end face has a step formed by at least one projected portion.

In the holding sealing material 20A shown in FIG. 9, two projected portions 23*a* and 23*c* are formed at the first end face 21, and one projected portion 23*b* is formed at the second end face 22. When the first end face 21 of the holding sealing material 20A is made in contact with the second end face 22 of the holding sealing material 20A, a convex formed by the projected portion 23*b* is likely to engage with a concave formed by the projected portion 23*a* and the projected portion 23*c*.

As mentioned earlier, in the holding sealing material 20A shown in FIG. 9, each of the first end face 21 and the second end face 22 has three levels of steps.

In the holding sealing material forming the exhaust gas purifying apparatus of the present embodiment, the lengths of the projected portions in the length direction of the holding sealing material are approximately the same with one another. Therefore, the distance between the first end face and the second end face is approximately the same at any part of the holding sealing material.

In the holding sealing material 20A shown in FIG. 9, the length of the projected portion 23*a* (shown by an arrow $X_4$ in FIG. 9), the length of the projected portion 23*b* (shown by an arrow $X_5$ in FIG. 9), and the length of the projected portion 23*c* (shown by an arrow $X_6$ in FIG. 9) are approximately the same from one another in the length $L_2$ direction of the holding sealing material 20A. Therefore, the holding sealing material 20A shown in FIG. 9 has an approximately constant length $L_2$.

The exhaust gas purifying apparatus of the present embodiment includes a holding sealing material having a length shorter than the circumferential length of the exhaust gas-treating body forming the exhaust gas purifying apparatus.

Therefore, a gap is formed between the first end face and the second end face of the holding sealing material when the holding sealing material is wound around the exhaust gas-treating body.

In the exhaust gas purifying apparatus 200 shown in FIG. 8A and FIG. 8B, the holding sealing material 20A shown in FIG. 9 is used as an example of the holding sealing material 210.

As shown in FIG. 8A and FIG. 8B, a gap 215*a*, a gap 215*b*, and a gap 215*c* are formed between a first end face 211*a* and a second end face 212*a*, between a first end face 211*b* and a second end face 212*b*, and between a first end face 211*c* and a second end face 212*c*, respectively, of the holding sealing material 210 wound around the exhaust gas-treating body 230. In the exhaust gas purifying apparatus 200 shown in FIG. 8A and FIG. 8B, the positive-side electrode member 250*a* is disposed at the gap 215*b*.

Moreover, a negative-side electrode 250*b* is disposed at the penetration portion 214*a* formed in the holding sealing material 210.

Meanwhile, in the exhaust gas purifying apparatus of the present embodiment, a negative-side electrode member may be disposed at a gap, and a positive-side electrode member may be disposed at a penetration portion.

In the exhaust gas purifying apparatus of the present embodiment, the length of the holding sealing material in the length direction is preferably from about 50% to about 99.8% of the circumferential length of the exhaust gas-treating body.

In the case that the length of the holding sealing material in the length direction is about 50% or more of the circumferential length of the exhaust gas-treating body, the area of the holding sealing material does not become too small, and thus the holding sealing material is likely to hold the exhaust gas-treating body sufficiently. In the case that the length of the holding sealing material in the length direction is about 99.8% or less of the circumferential length of the exhaust gas-treating body, a gap formed between the first end face and the second end face of the holding sealing material does not become too small when the holding sealing material is wound around the exhaust gas-treating body. Therefore, it is less likely to be difficult to dispose an electrode member or the like at the gap.

In the exhaust gas purifying apparatus of the present embodiment, the distance between the first end face and the second end face of the holding sealing material is preferably from about 1 mm to about 100 mm and more preferably from about 20 mm to about 40 mm when the holding sealing material is wound around the exhaust gas-treating body.

In the case that the distance between the first end face and the second end face is about 1 mm or more, the gap formed between the first end face and the second end face of the holding sealing material does not become too small when the holding sealing material is wound around the exhaust gas-treating body. It is thus less likely to be difficult to dispose an electrode member or the like at the gap. In the case that the distance between the first end face and the second end face of the holding sealing material is about 100 mm or less, the area of the holding sealing material does not become too small. Therefore, the holding sealing material is likely to hold the exhaust gas-treating body sufficiently.

In the holding sealing material forming the exhaust gas purifying apparatus of the present embodiment, the penetration portion is formed in a manner penetrating the holding sealing material in the thickness direction.

In the holding sealing material forming the exhaust gas purifying apparatus of the present embodiment, the number of the penetration portion is not particularly limited. Since a larger number of the penetration portion is likely to reduce the holding power of the holding sealing material, the number is preferably as small as possible, and is more preferably one.

In the holding sealing material forming the exhaust gas purifying apparatus of the present embodiment, the position of the penetration portion is not particularly limited. Preferably, the penetration portion is formed at a position where the penetration portion and a gap face each other with the exhaust gas-treating body interposed therebetween when the exhaust gas purifying apparatus is manufactured using the holding sealing material.

In the holding sealing material forming the exhaust gas purifying apparatus of the present embodiment, examples of the shape of the penetration portion of the holding sealing material include approximately round-pillar shape, approximately rectangular-pillar shape, approximately cylindroid shape, approximately truncated cone shape, and pillar shape having a bottom face surrounded by approximately straight line and approximately arc line. Examples of the cross-sectional shape of the penetration portion include approximately round shape, approximately polygonal shape such as approximately rectangular shape, approximately elliptical shape, approximately race track shape, and the like.

In the case of manufacturing an exhaust gas purifying apparatus using the aforementioned holding sealing material, the cross-sectional shape of the penetration portion is likely to be matched with the cross-sectional shape of an electrode member and the like.

In the case that a plurality of the penetration portions are formed in the holding sealing material, the shapes of the penetration portions may be the same or different from one another.

Meanwhile, the cross section of the penetration portion used herein refers to a cross section approximately in parallel with the main surface of the holding sealing material.

As used herein, the terms "approximately round pillar shape", "approximately round shape", "approximately perpendicular", "approximately parallel" and the like indicate that the shapes may not mathematically strict and respectively include shapes which are substantially the same as "round pillar shape", "round shape", "perpendicular", "parallel" and the like.

In the holding sealing material forming the exhaust gas purifying apparatus of the present embodiment, the diameter of the cross section of the penetration portion of the holding sealing material is preferably from about 1 mm to about 100 mm and more preferably from about 20 mm to about 40 mm.

If the diameter of the cross section of the penetration portion of the holding sealing material is about 1 mm or more, it is less likely to be difficult to dispose an electrode member or the like at the penetration portion when the holding sealing material is used in the exhaust gas purifying apparatus. If the diameter of the cross section of the penetration portion of the holding sealing material is about 100 mm or less, the area of the holding sealing material does not become too small. Therefore, the holding power of the holding sealing material is less likely to be reduced. Moreover, if the diameter of the cross section of the penetration portion of the holding sealing material is about 100 mm or less, the area of the holding sealing material in its width direction is less likely to decrease. Therefore, the tensile strength of the holding sealing material is less likely to decrease.

Moreover, in the holding sealing material forming the exhaust gas purifying apparatus of the present embodiment, the cross-sectional area of the penetration portion is preferably from about 1 $mm^2$ to about 10000 $mm^2$, and more preferably from about 400 $mm^2$ to about 1600 $mm^2$.

If the cross-sectional area of the penetration portion is about 1 $mm^2$ or more, it becomes easier to secure a sufficient area for disposing an electrode member or the like in use of the holding sealing material in the exhaust gas purifying apparatus. If the cross-sectional area of the penetration portion is about 10000 $mm^2$ or less, the area of the holding sealing material does not become too small. Therefore, the holding power of the holding sealing material is less likely to decrease.

The diameter of the cross section of the penetration portion refers to a diameter of a part approximately perpendicular to the thickness direction of the holding sealing material. In the case that the cross-sectional shape of the penetration portion is not an approximately round shape, the diameter refers to the maximum length passing through the center. The diameter of the cross section of the penetration portion is, for example, the diameter of the cross section if the penetration portion has approximately round pillar shape, the longer diameter of the cross section if the penetration portion has approximately cylindroid pillar shape, and the length of the longest part in the cross section if the penetration portion has approximately rectangular pillar shape or approximately polygonal pillar shape. If the penetration portion has approximately truncated cone shape, the diameter refers to the diameter of the larger one of the substantial circles.

The holding sealing material forming the exhaust gas purifying apparatus of the present embodiment may be provided with a binder such as organic binders.

The holding sealing material forming the exhaust gas purifying apparatus of the present embodiment may be a needle mat obtained by needling a base mat formed of inorganic fibers.

The following description will discuss one example of the method for manufacturing the holding sealing material forming the exhaust gas purifying apparatus of the present embodiment.

For example, a method including manufacturing the holding sealing material forming the exhaust gas purifying apparatus according to the first embodiment of the present invention and forming a penetration portion by punching the manufactured holding sealing material with a punching blade in a predetermined shape; a method including forming the penetration portion by punching simultaneously upon punching out the base mat; and the like are exemplified.

The holding sealing material forming the exhaust gas purifying apparatus of the present embodiment can be manufactured by the methods mentioned earlier.

The exhaust gas-treating body explained in the first embodiment of the present invention may be used as the exhaust gas-treating body forming the exhaust gas purifying apparatus of the present embodiment.

The following description will discuss the casing forming the exhaust gas purifying apparatus of the present embodiment.

Figure 10:
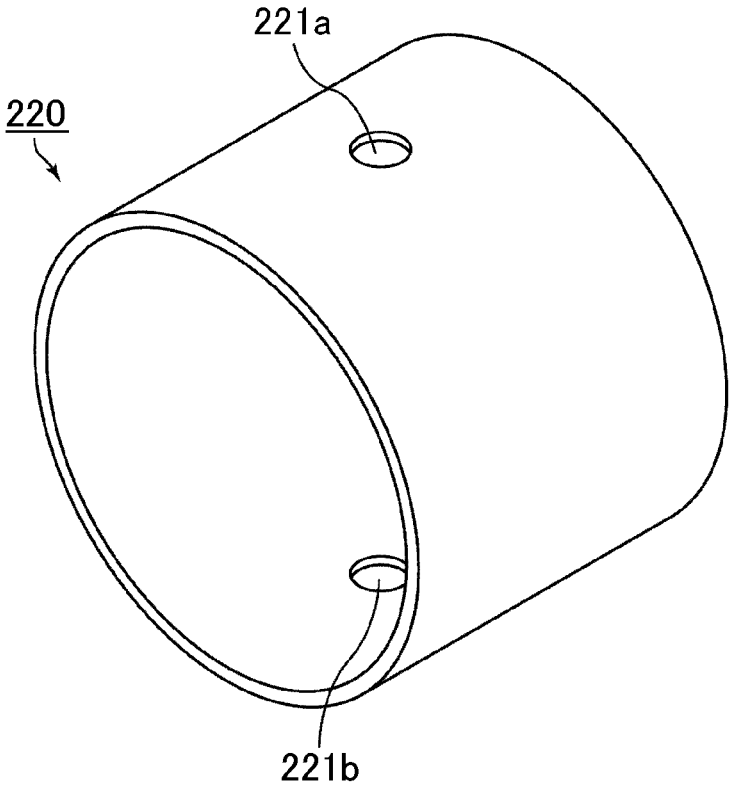
FIG. 10 is a perspective view schematically showing an example of a casing forming the exhaust gas purifying apparatus according to the second embodiment of the present invention.

FIG. 10 is a perspective view schematically showing an example of a casing forming the exhaust gas purifying apparatus according to the second embodiment of the present invention. The casing 220 shown in FIG. 10 is mainly made of metal such as stainless steel, and has an approximately cylindrical shape. The casing 220 has holes 221*a* and 221*b* for allowing an electrode member to penetrate therethrough.

The inner diameter of the casing 220 is made slightly shorter than a sum of the diameter of an end face of the exhaust gas-treating body and the thickness of the holding sealing material wound around the exhaust gas-treating body.

Meanwhile, the length of the casing may be slightly longer than the longitudinal direction length of the exhaust gas-treating body or may be approximately the same with the longitudinal direction length of the exhaust gas-treating body.

In the exhaust gas purifying apparatus 200 illustrated in FIG. 8A and FIG. 8B, the position of the gap 215*b* corresponds with the position of the hole 221*a* in the casing 220. The position of the penetration portion 214*a* in the holding sealing material 210 corresponds with the position of the hole 221*b* in the casing 220. The positive-side electrode member 250*a* is disposed at the gap 215*b* and the hole 221*a* of the casing 220. The negative-side electrode member 250*b* is disposed at the penetration portion 214*a* of the holding sealing material 210 and the hole 221*b* of the casing 220.

The electrode member forming the exhaust gas purifying apparatus of the present embodiment will be explained.

The electrode member is connected with a battery power supply. Voltage is directly applied from the battery power supply to the electrode member. Accordingly, the exhaust gas-treating body connected with the electrode member is likely to be charged with a current.

The position to dispose the electrode member is not particularly limited. Taking an efficient heating of the exhaust gas-treating body into consideration, the electrode members are preferably disposed at a position where the positive-side electrode member and the negative-side electrode member stand opposite one another.

The exhaust gas purifying apparatus of the present embodiment may further include a sensor such as a temperature sensor and an oxygen sensor, similarly to the exhaust gas purifying apparatus according to the first embodiment of the present invention.

Figure 11A:
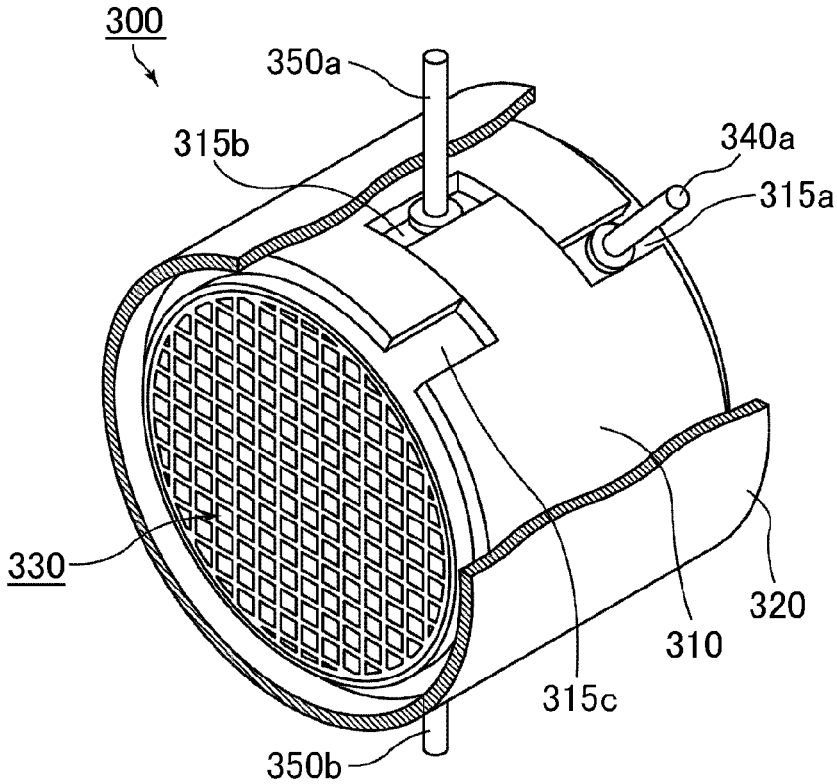
FIG. 11A is a perspective cross-sectional cutaway view schematically showing one of other examples of the exhaust gas purifying apparatus according to the second embodiment of the present invention.
Figure 11B:
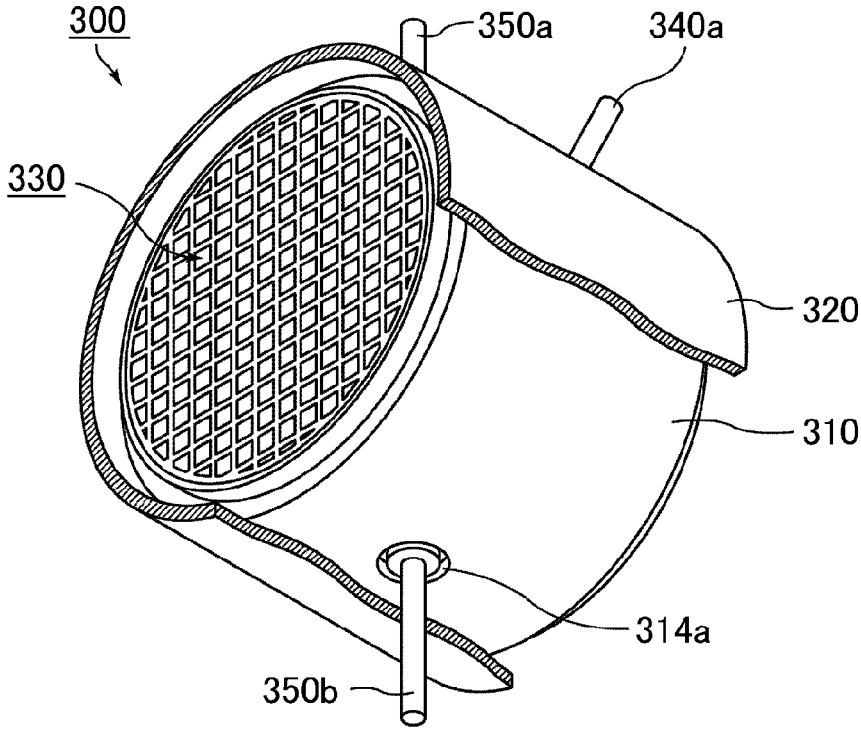
FIG. 11B is a perspective cross-sectional cutaway view seen from below the exhaust gas purifying apparatus shown in FIG. 11A.

FIG. 11A is a perspective cross-sectional cutaway view schematically showing one of other examples of the exhaust gas purifying apparatus according to the second embodiment of the present invention. FIG. 11B is a perspective cross-sectional cutaway view seen from below the exhaust gas purifying apparatus shown in FIG. 11A.

In the exhaust gas purifying apparatus 300 shown in FIG. 11A and FIG. 11B, the holding sealing material 20A shown in FIG. 9 is used as the holding sealing material 310. In this case, for example, a sensor 340*a*, a positive-side electrode member 350*a*, and a negative-side electrode member 350*b* are likely to be disposed in a gap 315*a*, a gap 315*b*, and a penetration portion 314*a*, respectively.

Although not shown in FIG. 11A and FIG. 11B, a casing 320 forming the exhaust gas purifying apparatus 300 is provided with three holes for allowing the sensor and the electrode members to penetrate therein.

The following description will discuss the method for manufacturing an exhaust gas purifying apparatus according to the second embodiment of the present invention with reference to the drawings.

FIG. 12A, FIG. 12B, FIG. 12C, and FIG. 12D each are a perspective view schematically showing an example of a method for manufacturing the exhaust gas purifying apparatus according to the second embodiment of the present invention.

FIG. 12A, FIG. 12B, FIG. 12C, and FIG. 12D illustrate a method for manufacturing the exhaust gas purifying apparatus 200 shown in FIG. 8A and FIG. 8B as an example of the method for manufacturing the exhaust gas purifying apparatus according to the second embodiment of the present invention.

Figure 12A:
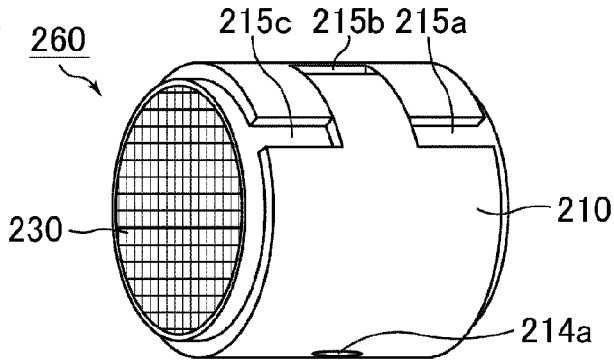
FIG. 12A, FIG. 12B, FIG. 12C, and FIG. 12D each are a perspective view schematically showing an example of a method of manufacturing an exhaust gas purifying apparatus according to the second embodiment of the present invention.

First, as shown in FIG. 12A, winding step is performed by winding the holding sealing material 210 around the exhaust gas-treating body 230 to manufacture a wound body (exhaust gas-treating body wound with the holding sealing material) 260.

The holding sealing material 20A illustrated in FIG. 9 is used as the holding sealing material 210. In this case, since the length of the holding sealing material 210 is shorter than the circumferential length of the exhaust gas-treating body 230, a gap 215*a*, a gap 215*b*, and a gap 215*c* are formed between the first end face and the second end face of the holding sealing material 210. The penetration portion 214*a* is formed in the holding sealing material 210.

Figure 12B:
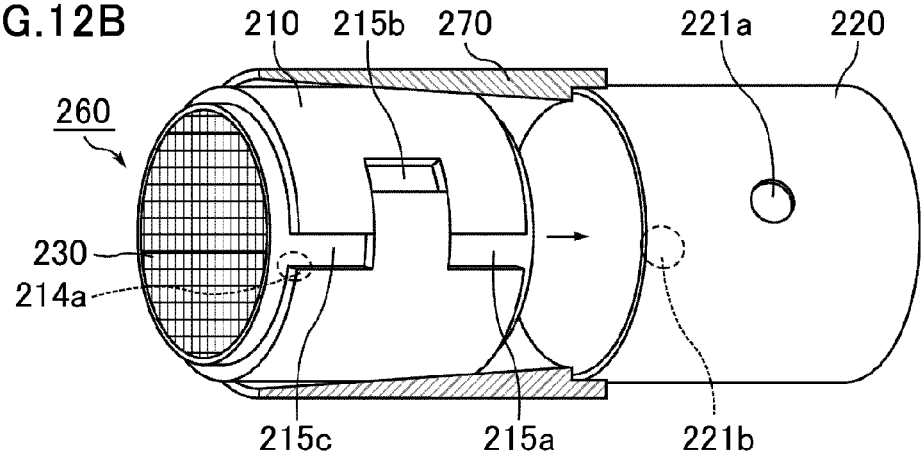

Next, as shown in FIG. 12B, housing step is performed by housing the manufactured wound body 260 in the casing 220 having approximately a cylindrical shape.

Examples of the method for housing the wound body in the casing include a stuffing method (press-fitting method), a sizing method (swaging method), and a clam shell method, which are explained in the first embodiment of the present invention.

A stuffing method or a sizing method (swaging method) is preferable among the methods for housing the wound body in the casing. This is because a stuffing method or a sizing method (swaging method)

does not require two parts as casing, and therefore it becomes easier to reduce the number of manufacturing process.

FIG. 12B illustrates a method for stuffing the wound body 260 in the casing 220 with a stuffing jig 270.

The stuffing jig 270 has a similar structure as that of the stuffing jig 170 explained in the first embodiment of the present invention.

The method for stuffing the wound body in the casing is not particularly limited, and may be a method including stuffing the wound body by pushing the wound body with hands into the casing, and the like.

Figure 12C:
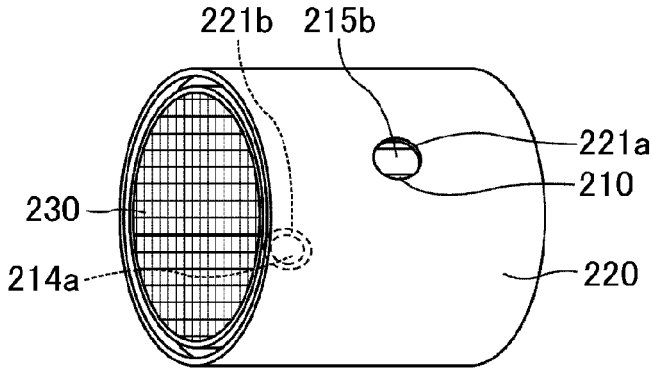

Thereafter, as shown in FIG. 12C, position adjustment step is performed by adjusting the position of the gap 215*b* formed between the first end face and the second end face of the holding sealing material 210 and the position of the penetration portion 214*a* to the positions of the holes 221*a* and 221*b* of the casing 220, respectively.

As the method for adjusting the position of the gap and the position of the penetration portion to the positions of the holes of the casing, a method including rotation of the wound body housed in the casing, and the like can be exemplified.

In the above housing step, in the case of housing the wound body in the casing while adjusting the positions of the gap and the penetration portion to match the position of the hole of the casing, the housing step and the position adjustment step are likely to be performed simultaneously.

Thereafter, the first disposing step is performed by disposing an electrode member in a manner as to be connected with the exhaust gas-treating body, to pass through the holding sealing material, and to penetrate the casing. Also, the second disposing step is performed by disposing another electrode member in a manner that it connects to the exhaust gas-treating body, passes through the holding sealing material, and penetrates the casing.

Figure 12D:
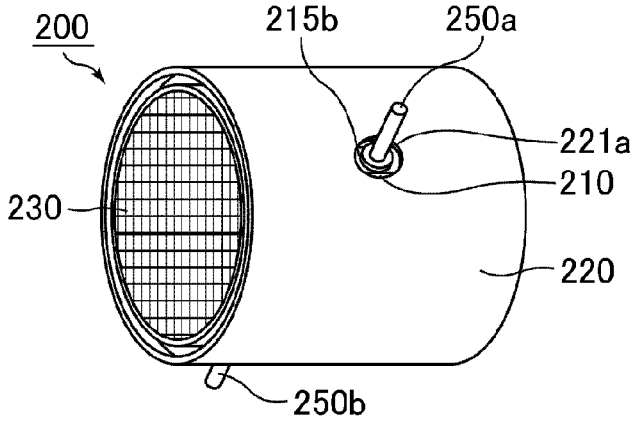

As shown in FIG. 12D, in the first disposing step, the positive-side electrode member 250*a* is allowed to pass through the hole 221*a* which is one of the holes formed in the casing 220 and the gap 215*b* formed between the first end face and the second end face of the holding sealing material 210 so that the positive-side electrode member 250*a* is connected to the exhaust gas-treating body 230. In the second disposing step, the negative-side electrode member 250*b* is allowed to pass through the other hole 221*b* formed in the casing 220 and the penetration portion 214*a* formed in the holding sealing material 210 so that the negative-side electrode member 250*b* is connected to the exhaust gas-treating body 230.

Either the first disposing step or the second disposing step may be performed first as long as the disposing steps are performed after the position adjustment step (after the housing step in the case where housing step and the position adjustment step are simultaneously performed).

Through the above process, the exhaust gas purifying apparatus 200 shown in FIG. 8A and FIG. 8B can be manufactured.

In the aforementioned method for manufacturing an exhaust gas purifying apparatus according to the present embodiment, the positive-side electrode member is disposed at the gap and the hole of the casing, and the negative-side electrode member is disposed in the penetration portion and the hole of the casing after housing the wound body in the casing.

In the method for manufacturing an exhaust gas purifying apparatus according to the present embodiment, if a clam shell method is applied, the wound body may be housed in the casing in a following manner. Namely, the wound body is placed on the first casing having holes in a manner that the position of the penetration portion of the holding sealing material corresponds to the hole of the first casing; the positive-side electrode member is disposed at the gap; the negative-side electrode member is disposed at the penetration portion and the hole of the first casing; and then the second casing is placed on top with the positive-side electrode member passing through the hole formed in the second casing.

Moreover, in the method for manufacturing an exhaust gas purifying apparatus according to the present embodiment, if a clam shell method is applied, an electrode-attached wound body may be manufactured as follows. Namely, an electrode-attached body is prepared by firstly fixing the positive-side electrode member and the negative-side electrode member to predetermined positions of the exhaust gas-treating body; allowing the negative-side electrode member to pass through the penetration portion in the holding sealing material; and then winding the holding sealing material around the exhaust gas-treating body in a manner avoiding the positive-side electrode member. In this case, after placing the electrode-attached wound body on the first casing having a hole in a manner to allow the negative-side electrode member to pass through the hole, the second casing is placed on top in a manner allowing the positive-side electrode member to pass through the hole formed in the second casing so that the wound body is housed in the casing.

In the present embodiment, not only the effects (1) to (4) explained in the first embodiment of the present invention but also the following effects can be exerted.

(5) In the method of manufacturing the exhaust gas purifying apparatus, and the exhaust gas purifying apparatus according to the present embodiment, a holding sealing material having a penetration portion penetrating the holding sealing material in the thickness direction of the holding sealing material is used.

Therefore, an electrode member is likely to be disposed at the gap formed between the first end face and the second end face of the holding sealing material, and also another electrode member is likely to be disposed at the penetration portion.

(6) Since electrode members are likely to be disposed in the exhaust gas purifying apparatus of the present embodiment, the exhaust gas purifying apparatus of the present embodiment is likely to be used as an electrically heated catalyst converter.

Third Embodiment

The following description will discuss a third embodiment that is one of the embodiments of the present invention.

In the first and the second embodiments of the present invention, each of the first end face and the second end face of the holding sealing material forming the exhaust gas purifying apparatus has three levels of steps. In contrast, in the method of manufacturing an exhaust gas purifying apparatus, and the exhaust gas purifying apparatus according to the third embodiment of the present invention, each of the first end face and the second end face of the holding sealing material forming the exhaust gas purifying apparatus has two levels of steps.

The exhaust gas purifying apparatus according to the third embodiment of the present invention will be described.

The exhaust gas purifying apparatus according to the third embodiment of the present invention has a similar structure as that of the exhaust gas purifying apparatus according to the first embodiment or the second embodiment of the present invention, except for the structure of the holding sealing material. Therefore, the holding sealing material forming the exhaust gas purifying apparatus of the present embodiment is mainly explained.

In the holding sealing material forming the exhaust gas purifying apparatus of the present embodiment, one projected portion is formed in the first end face, and one projected portion is formed in the second end face. Namely, the holding sealing material forming the exhaust gas purifying apparatus of the present embodiment has two levels of steps.

Figure 13A:
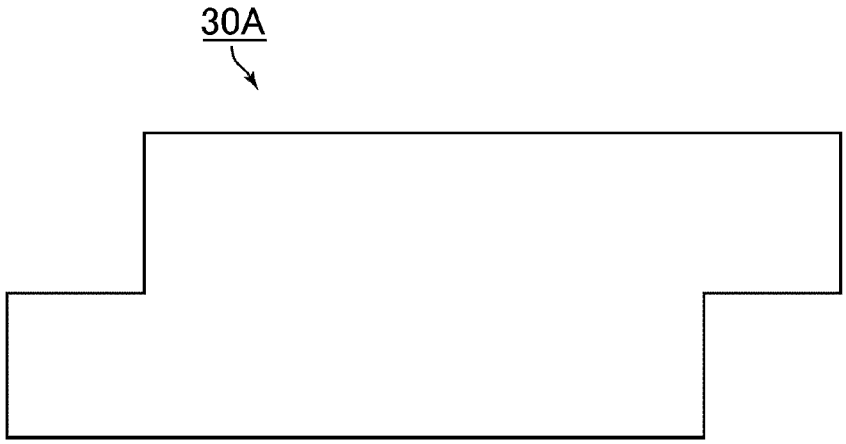
FIG. 13A and FIG. 13B each are a plain view schematically showing an example of a holding sealing material forming the exhaust gas purifying apparatus according to a third embodiment of the present invention.
Figure 13B:
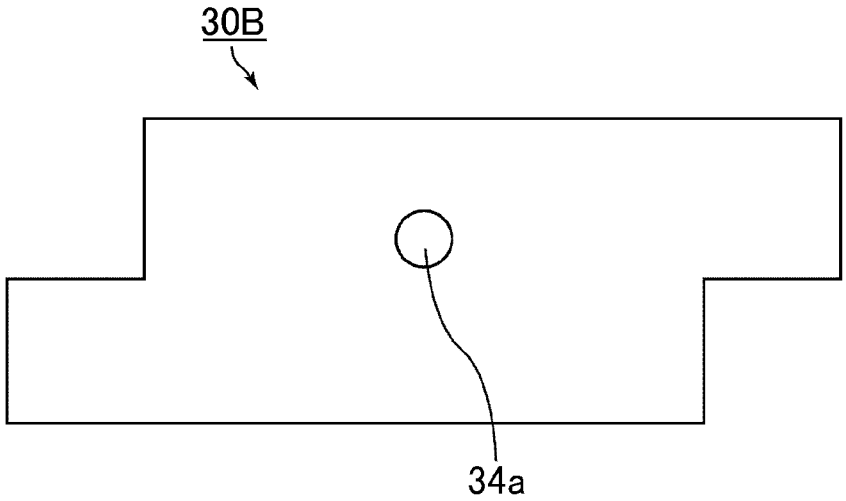

FIG. 13A and FIG. 13B each are a plain view schematically showing an example of a holding sealing material forming the exhaust gas purifying apparatus according to the third embodiment of the present invention.

A holding sealing material 30A shown in FIG. 13A has a similar structure as that of the holding sealing material 10A shown in FIG. 4, which is one example the holding sealing material forming the exhaust gas purifying apparatus according to the first embodiment of the present invention, except that two levels of steps are provided.

A holding sealing material 30B shown in FIG. 13B has a similar structure as that of the holding sealing material 30A shown in FIG. 13A, except that the penetration portion 34*a* explained in the second embodiment of the present invention is formed.

Meanwhile, with regard to the holding sealing material 30A shown in FIG. 13A and the holding sealing material 30B shown in FIG. 13B, each of the projected portion is likely to engage with a portion facing the projected portion when the first end face of the holding sealing material is made in contact with the second end face of the holding sealing material.

In the exhaust gas purifying apparatus according to the present embodiment, the holding sealing material having a length shorter than the circumferential length of the exhaust gas-treating body forming the exhaust gas purifying apparatus is used as well.

Therefore, a gap is formed between the first end face and the second end face of the holding sealing material when the holding sealing material is would around the exhaust gas-treating body.

The holding sealing material forming the exhaust gas purifying apparatus of the present embodiment has a similar structure as that of the holding sealing material forming the exhaust gas purifying apparatus according to the first embodiment or the second embodiment of the present invention, except that two levels of steps are formed.

The exhaust gas-treating body explained in the first embodiment of the present invention can be used as the exhaust gas-treating body forming the exhaust gas purifying apparatus of the present embodiment.

The casing explained in the first embodiment or the second embodiment of the present invention can be used as the casing forming the exhaust gas purifying apparatus of the present embodiment.

The sensor explained in the first embodiment of the present invention can be used as the sensor forming the exhaust gas purifying apparatus of the present embodiment. The electrode member explained in the second embodiment of the present invention can be used as the electrode member forming the exhaust gas purifying apparatus of the present embodiment.

The method of manufacturing the exhaust gas purifying apparatus according to the third embodiment of the present invention is similar as the method of manufacturing the exhaust gas purifying apparatus according to the first embodiment or the second embodiment of the present invention.

In the present embodiment, the effects (1) to (4) explained in the first embodiment of the present invention and the effects (5) to (6) explained in the second embodiment of the present invention can be exerted.

Other Embodiment

In the method of manufacturing an exhaust gas purifying apparatus, and the exhaust gas purifying apparatus according to the first embodiment or the second embodiment of the present invention, each of the first end face and the second end face of the holding sealing material forming the exhaust gas purifying apparatus has three levels of steps. In the method of manufacturing an exhaust gas purifying apparatus, and the exhaust gas purifying apparatus according to the third embodiment of the present invention, each of the first end face and the second end face of the holding sealing material has two levels of steps.

However, in the method of manufacturing an exhaust gas purifying apparatus, and the exhaust gas purifying apparatus according to the embodiment of the present invention, the number of levels of the steps in the holding sealing material forming the exhaust gas purifying apparatus is not particularly limited. Therefore, each of the first end face and the second end face of the holding sealing material may have four levels or more of steps.

Meanwhile, in the case that each of the first end face and the second end face of the holding sealing material has three levels or more of steps, a convex formed by the projected portion preferably engages with a concave formed by the projected portions when the first end face of the holding sealing material is made in contact with the second end face of the holding sealing material.

In the method of manufacturing an exhaust gas purifying apparatus, and the exhaust gas purifying apparatus according to the embodiment of the present invention, each of the first end face and the second end face of the holding sealing material forming the exhaust gas purifying apparatus may have no step.

In the method of manufacturing an exhaust gas purifying apparatus, and the exhaust gas purifying apparatus according to the first to the third embodiments of the present invention, a sensor such as a temperature sensor and an oxygen sensor is disposed at a gap formed between the first end face and the second end face of the holding sealing material forming the exhaust gas purifying apparatus.

In the method of manufacturing an exhaust gas purifying apparatus, and the exhaust gas purifying apparatus according to the first to the third embodiments of the present invention, the member to be disposed at a gap formed between the first end face and the second end face of the holding sealing material forming the exhaust gas purifying apparatus is not limited to a sensor, but may be an electrode member.

For example, in the exhaust gas purifying apparatus 100 shown in FIG. 2A and FIG. 2B, an electrode member may be disposed at each of the gap 115*a* and the gap 115*c*. Moreover, a sensor may be disposed at each of the gap 115*a* and the gap 115*c*.

In the method of manufacturing an exhaust gas purifying apparatus, and the exhaust gas purifying apparatus according to the embodiment of the present invention, at least one of an electrode member and a sensor may be disposed at any position as long as it is disposed at a gap between the first end face and the second end face of the holding sealing material. For example, a plurality of electrode members and/or sensors may be disposed at one gap.

In the first to the third embodiments of the present invention, the methods for manufacturing the exhaust gas purifying apparatus using stuffing system (press-fitting system) are mainly explained.

The exhaust gas purifying apparatuses according to the embodiment of the present invention may also be manufactured by a sizing method (swaging method). One example of the method of manufacturing the exhaust gas purifying apparatus using a sizing method will be explained below with reference to the drawings. Meanwhile, since the winding step, position adjustment step, and disposing step (first disposing step) are similar with those applied in the first embodiment of the present invention, only a housing step will be described.

Figure 14A:
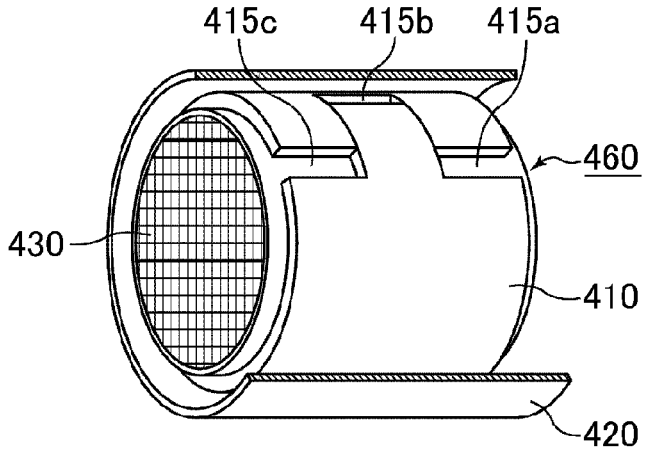
FIG. 14A, FIG. 14B and FIG. 14C each are a perspective view schematically showing one of other examples of a housing step in the method of manufacturing an exhaust gas purifying apparatus according to the embodiment of the present invention.
Figure 14B:
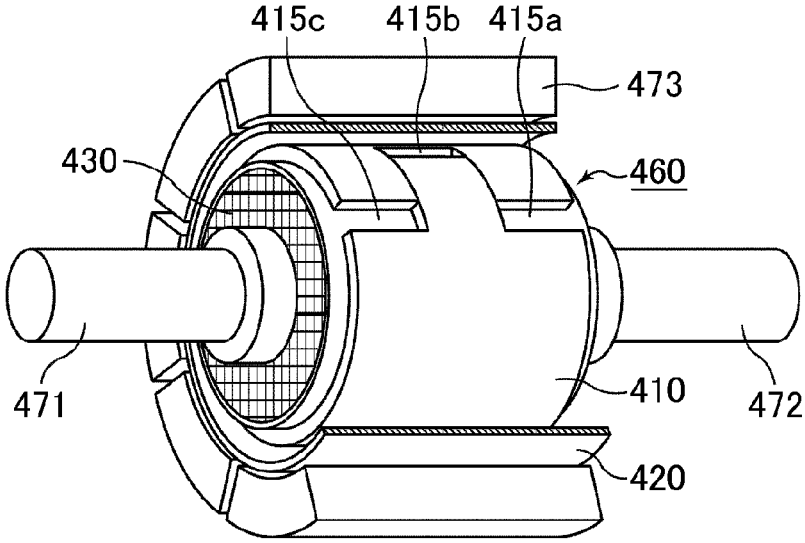
Figure 14C:
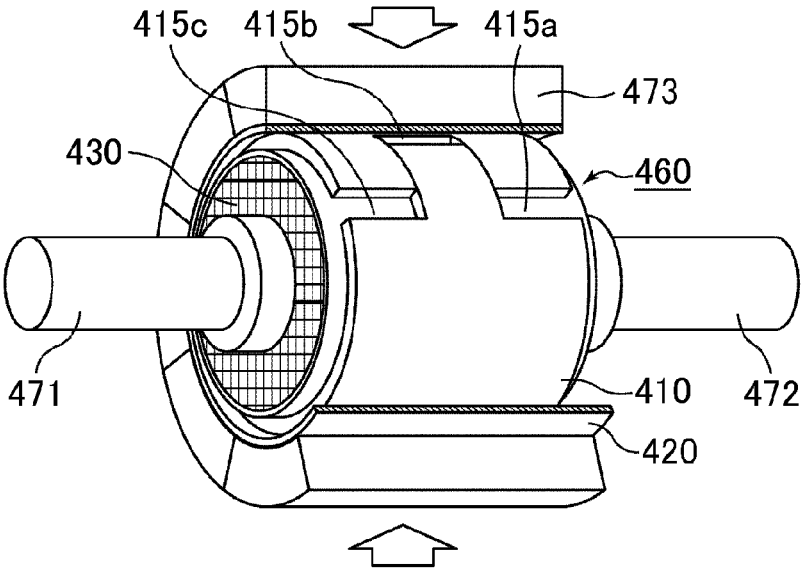

FIG. 14A, FIG. 14B and FIG. 14C each are a perspective view schematically showing one of other examples of housing step in the method of manufacturing an exhaust gas purifying apparatus according to the embodiment of the present invention.

In the housing step, first, as shown in FIG. 14A, a wound body 460 (an exhaust gas-treating body 430 with a holding sealing material 410 wound therearound) is softly introduced into the casing 420.

As used herein, the wording "softly" means "not stuffing," or specifically means introducing the wound body with no contact between the holding sealing material 410 and the inner wall of the casing 420 or introducing the wound body in such a slightly compressed state that does not cause damage in the holding sealing material 410 regardless of occurrence of the contact. Preferably, the wound body is introduced in the casing while being supported by later-described shafts 471 and 472 shown in FIG. 14B in a state that the wound body 460 would drop from the casing 420 unless it is supported by the shafts.

Next, as shown in FIG. 14B, the exhaust gas-treating body 430 is shifted in the casing 420 while being sandwiched by the shafts 471 and 472 so that the exhaust gas-treating body 430 is held at a predetermined position.

Thereafter, the diameter of the casing 420 is reduced as shown in FIG. 14C. In other words, compression force is applied to the outer circumference of the casing 420 to reduce the inner diameter of the casing 420. Specifically, the body of the casing 420 is pressed by a collet 473 from the outer circumference of the casing 420 in the centripetal direction to compress the portion and the holding sealing material 410 existing therein. Thereby, the holding sealing material 410 and the exhaust gas-treating body 430 are held inside the casing 420. The exhaust gas-treating body 430 is held at a predetermined position in the casing 420 by the surface pressure generated by the repulsion from the compressed holding sealing material 410.

Through the above process, the wound body is likely to be housed in the casing.

In the method of manufacturing an exhaust gas purifying apparatus, and the exhaust gas purifying apparatus according to the embodiment of the present invention, if a projected portion is formed in the first end face and the second end face of the holding sealing material forming the exhaust gas purifying apparatus, the size of the projected portion is preferably from about 10 mm in width×about 10 mm in length to about 200 mm in width×about 200 mm in length, and more preferably from about 20 mm in width×about 20 mm in length to about 100 mm in width×about 100 mm in length.

If the holding sealing material having the projected portion with the aforementioned shape is used for manufacturing an exhaust gas purifying apparatus, since the holding sealing material tends to more easily fit due to the projected portion, the exhaust gas-treating body is likely to be supported firmly by the holding sealing material.

If the size of the projected portion is not less than about 10 mm in width×about 10 mm in length or not more than about 200 mm in width×about 200 mm in length, the contact area between the first end face and the second end face of the holding sealing material is not too small when the holding sealing material is wound around the exhaust gas-treating body. Therefore, the first end face and the second end face of the holding sealing material are likely to be bonded one another. As a result, the exhaust gas-treating body is likely to be easily supported by the holding sealing material.

In the method of manufacturing an exhaust gas purifying apparatus, and the exhaust gas purifying apparatus according to the embodiment of the present invention, the inorganic fibers forming the holding sealing material forming the exhaust gas purifying apparatus are not limited to the aforementioned inorganic fibers containing alumina and silica, but may be inorganic fibers containing other inorganic compounds as well.

Moreover, of alumina and silica, the inorganic fibers containing only alumina or the inorganic fibers containing only silica may be used.

As the compounding amount of the inorganic fibers containing alumina and silica, a weight ratio of $Al_2O_3$:$SiO_2$ in a range from about 60:40 to about 80:20 is preferably used, and more preferably, a weight ratio of $Al_2O_3$:$SiO_2$ in a range from about 70:30 to about 74:26 is used.

If the alumina content is not more than the preferable maximum alumina content ($Al_2O_3$:$SiO_2$=about 80:20) in the above compounding amount, crystallization of alumina and silica tends not to easily proceed. Thus, the flexibility of the inorganic fibers is less likely to decrease. Moreover, if the silica content is not less than the preferable minimum silica content ($Al_2O_3$:$SiO_2$=about 80:20) in the above compounding amount, the rigidity of the inorganic fibers is less likely to be lacking, making it easier to achieve sufficient shear strength. As a result, the winding property to the exhaust gas-treating body is less likely to decrease, and thus the holding sealing material is less likely to break.

In the case of the inorganic fibers containing only alumina of alumina and silica, in addition to alumina, for example, additives, such as CaO, MgO and $ZrO_2$, may be contained therein.

The inorganic fibers containing only silica, of alumina and silica, may also contain additives such as CaO, MgO and $ZrO_2$, in addition to silica.

In the method of manufacturing an exhaust gas purifying apparatus, and the exhaust gas purifying apparatus according to the embodiment of the present invention, the average fiber length of the inorganic fibers forming the holding sealing material forming the exhaust gas purifying apparatus is preferably from about 5 mm to about 150 mm, and more preferably from about 10 mm to about 80 mm.

In the case of the inorganic fibers having average fiber length of about 5 mm or more, since the fiber length of the inorganic fibers is not too short, the inorganic fibers are less likely to entangle one another insufficiently. As a result, the shear strength of the holding sealing material is less likely to be low. In the case of the inorganic fibers having average fiber length of about 150 mm or less, since the fiber length of the inorganic fibers is not too long, handling property of the inorganic fibers is less likely to deteriorate. As a result, the winding property to the exhaust gas-treating body is less likely to deteriorate, and thus the holding sealing material tends not to break easily.

In the method of manufacturing an exhaust gas purifying apparatus, and the exhaust gas purifying apparatus according to the embodiment of the present invention, the average fiber diameter of the inorganic fibers forming the holding sealing material forming the exhaust gas purifying apparatus is preferably from about 1 μm to about 20 μm, and more preferably from about 3 μm to about 10 μm.

In the case of the inorganic fibers having average fiber diameter of from about 1 μm to about 20 μm, the strength and the flexibility of the inorganic fibers are likely to be sufficiently high, making it easier to improve the shear strength of the holding sealing material.

In the case of the inorganic fibers having average fiber diameter of about 1 μm or more, the inorganic fibers are not thin and thus tend not to break easily. Therefore, the tensile strength of the inorganic fibers is less likely to be insufficient. In the case of the inorganic fibers having average fiber diameter of about 20 μm or less, the inorganic fibers tends to bend, and thus the flexibility tends not to be insufficient.

In the method of manufacturing an exhaust gas purifying apparatus, and the exhaust gas purifying apparatus according to the embodiment of the present invention, the weight per unit area of the holding sealing material forming the exhaust gas purifying apparatus is preferably from about 500 g/m$^2$ to about 7000 g/m$^2$, and more preferably from about 1000 g/m$^2$ to about 4000 g/m$^2$, although not limited thereto. In the case of the weight per unit area of the holding sealing material of about 500 g/m$^2$ or more, the holding sealing material tends to have sufficient holding power. In the case of the weight per unit area of the holding sealing material is about 7000 g/m$^2$ or less, the volume of the holding sealing material tends to be reduced. For this reason, if an exhaust gas purifying apparatus is manufactured by using the holding sealing material of the above two cases, the exhaust gas-treating body is less likely to easily drop from the casing.

The bulk density of the holding sealing material (bulk density of the holding sealing material before a wound body is stuffed into a casing) is preferably from about 0.05 g/cm$^3$ to about 0.30 g/cm$^3$, although not limited thereto. In the case of the bulk density of the holding sealing material of about 0.05 g/cm$^3$ or more, the inorganic fibers are less likely to weakly entangle and are less likely to separate from one another. Therefore, a predetermined shape of the holding sealing material tends to be easily maintained. In the case of the bulk density of the holding sealing material of about 0.30 g/cm$^3$ or less, the holding sealing material is less likely to be hard. Therefore, the winding property to the exhaust gas-treating body is less likely to deteriorate. Thus, the holding sealing material is less likely to break easily.

In the method of manufacturing an exhaust gas purifying apparatus, and the exhaust gas purifying apparatus according to the embodiment of the present invention, the thickness of the holding sealing material forming the exhaust gas purifying apparatus is preferably from about 3 mm to about 50 mm, and more preferably from about 6 mm to about 20 mm, although not limited thereto. In the case of the thickness of the holding sealing material of about 3 mm or more, the holding sealing material tends to have sufficient holding power. If an exhaust gas purifying apparatus is manufactured by using the holding sealing material of this kind, the exhaust gas-treating body is less likely to drop from the casing. In the case of the thickness of the holding sealing material of about 50 mm or less, the holding sealing material is not too thick. Therefore, the winding property to the exhaust gas-treating body is less likely to deteriorate, and thus the holding sealing material is less likely to break easily.

In the case that a binder is added in the holding material forming the exhaust gas purifying apparatus in the method of manufacturing an exhaust gas purifying apparatus, and the exhaust gas purifying apparatus according to the embodiment of the present invention, examples of the method for adding a binder in the holding sealing material include a method which includes approximately uniformly spraying a binder solution containing an organic binder and the like to the entire holding sealing material with a spray and the like.

Examples of the organic binder contained in the binder solution include an acrylic resin, rubber such as acrylic rubber, a water soluble organic polymer such as carboxymethyl cellulose or polyvinyl alcohol, a thermoplastic resin such as styrene resin, and a thermosetting resin such as an epoxy resin.

Among the examples, acrylic rubber, acrylonitrile-butadiene rubber, and styrene-butadiene rubber are in particular preferable.

The compounding amount of the organic binder is preferably from about 0.5% by weight to about 15% by weight relative to the total weight of the inorganic fibers, the organic binder and the inorganic binder.

In the case of the compounding amount of the organic binder of about 0.5% by weight or more relative to the total weight of the inorganic fibers, the organic binder and the inorganic binder, the amount of the organic binder is not too small, and thus scattering of the inorganic fibers is less likely to occur. Therefore, the strength of the holding sealing material is less likely to decrease. In the case of the compounding amount of the organic binder of about 15% by weight or less relative to the total weight of the inorganic fibers, the organic binder and the inorganic binder, if the holding sealing material is used in an electrically heating exhaust gas purifying apparatus, the amount of the discharged organic components derived from the organic binder in the discharged exhaust gas is less likely to increase. This tends not to increase environmental burden.

The binder solution may contain a plurality of kinds of the aforementioned organic binders.

Moreover, as the binder solution, in addition to a latex formed by dispersing the organic binder in water, a solution or the like prepared by dissolving the organic binder in water or an organic solvent may be used.

In the case that an inorganic binder is contained in the binder solution, examples of the inorganic binder include alumina sol, silica sol, or the like.

The compounding amount of the inorganic binder is preferably from about 0.5% by weight to about 15% by weight relative to the total of the inorganic fibers, the organic binder and the inorganic binder, although the compound ratio is not particularly limited as long as it tends to combine the inorganic fibers.

In the case of the compounding amount of the inorganic binder of about 0.5% by weight or more relative to the total of the inorganic fibers, the organic binder and the inorganic binder, the amount of the inorganic binder is not too small, and thus scattering of the inorganic fibers is less likely to occur. Therefore, the strength of the holding sealing material is less likely to decrease. In the case of the compounding amount of the inorganic binder of about 15% by weight or less relative to the total of the inorganic fibers, the organic binder and the inorganic binder, the holding sealing material does not become too hard. As a result, the holding sealing material is less likely to break.

In the case that the holding sealing material forming the exhaust gas purifying apparatus has been provided with a needling treatment in the method of manufacturing an exhaust gas purifying apparatus, and the exhaust gas purifying apparatus according to the embodiments of the present invention, the needling treatment may be performed on the entire base mat or a part of the base mat.

The needling treatment may be performed before adding the binder to the holding sealing material, or may be performed after adding the binder to the holding sealing material.

The needling treatment may be performed with, for example, a needling machine. The needling machine includes a support plate for supporting the base mat, and a needle board which is disposed at an upper side of the support plate and is capable of reciprocating in the punching direction (thickness direction of base mat). A large number of needles are attached to the needle board. The needle board is shifted on the base mat mounted on the support plate. By inserting and withdrawing the plurality of needles to and from the base mat, the inorganic fibers forming the base mat tend to intricately entangle with one another.

The times of the needling treatment or the number of needles may be changed depending on the desired bulk density, the weight per unit area, or the like.

With regard to the holding sealing material forming the exhaust gas purifying apparatus in the method of manufacturing an exhaust gas purifying apparatus, and the exhaust gas purifying apparatus according to the embodiments of the present invention, the number of sheets of the holding sealing material is not particularly limited, and one sheet of the holding sealing material may be used, or a plurality of sheets of the holding sealing materials mutually combined with one another may also be used.

Examples of the method for combining the plurality of holding sealing materials include a method in which the holding sealing materials are mutually stitched together with a sewing machine, a method in which holding sealing materials are mutually bonded to one another by using an adhesive tape, an adhesive material or the like, although not limited thereto.

In the method of manufacturing an exhaust gas purifying apparatus, and the exhaust gas purifying apparatus according to the embodiments of the present invention, the material for the casing forming the exhaust gas purifying apparatus is not particularly limited as long as it is a metal having heat resistance, and specific examples of the material include metals such as stainless steel, aluminum and iron.

In the method of manufacturing an exhaust gas purifying apparatus, and the exhaust gas purifying apparatus according to the embodiments of the present invention, the shape of the casing forming the exhaust gas purifying apparatus may be preferably prepared as a clam shell shape, a down-sizing type shape, or the like, in addition to an approximately cylindrical shape.

In the method of manufacturing an exhaust gas purifying apparatus, and the exhaust gas purifying apparatus according to the embodiments of the present invention, the shape of the exhaust gas-treating body forming the exhaust gas purifying apparatus is not particularly limited as long as it is a pillar shape. In addition to an approximately round pillar shape, for example, a desired shape, such as an approximately cylindroid shape or an approximately rectangular pillar shape, with a desired size, may be used.

In the method of manufacturing an exhaust gas purifying apparatus, and the exhaust gas purifying apparatus according to the embodiments of the present invention, the exhaust gas-treating body forming the exhaust gas purifying apparatus may be a honeycomb structured body which includes a cordierite or the like and is integrally formed as shown in FIG. 3. The exhaust gas-treating body may also be a honeycomb structured body including silicon carbide or the like, in which a plurality of pillar-shaped honeycomb fired bodies are bonded by interposing an adhesive layer mainly containing ceramic therebetween, each of the honeycomb fired bodies having a large number of through holes placed in parallel with one another in the longitudinal direction with a separation wall interposed therebetween. Moreover, the exhaust gas-treating body forming the exhaust gas purifying apparatus may be a metal-made exhaust gas-treating body.

In the case of using the exhaust gas purifying apparatus according to the embodiments of the present invention as an electrically heated catalyst converter, a preferable material for the exhaust gas-treating body is a conductive ceramic such as phosphorus doped silicon carbide because of its excellent electric conductivity.

In the method of manufacturing an exhaust gas purifying apparatus, and the exhaust gas purifying apparatus according to the embodiments of the present invention, the exhaust gas-treating body forming the exhaust gas purifying apparatus is not limited to a catalyst carrier, and may be, for example, a honeycomb structured body in which a large number of cells are placed in parallel with one another in the longitudinal direction with a cell wall interposed therebetween, with either end of each cell sealed with a plug, and the like. In this case, the exhaust gas-treating body is likely to function as a filter (DPF) capable of removing PM contained in exhaust gas.

In the method of manufacturing an exhaust gas purifying apparatus, and the exhaust gas purifying apparatus according to the embodiments of the present invention, if a catalyst is supported on the exhaust gas-treating body forming the exhaust gas purifying apparatus, examples of the catalyst supported on the exhaust gas-treating body include noble metals such as platinum, palladium and rhodium. These catalysts may be used alone, or two or more kinds of these may be used in combination.

Examples of the catalyst also include alkali metals such as potassium and sodium, alkaline earth metals such as barium, metal oxides such as cerium oxide, and the like.

Examples of the method for supporting a catalyst on the exhaust gas-treating body include a method including heating the exhaust gas-treating body after having been impregnated with a solution containing a catalyst, a method including forming a catalyst supporting layer made of an alumina film on the surface of the exhaust gas-treating body and supporting a catalyst on the alumina film, and the like.

Examples of the method for forming the alumina film include a method in which the exhaust gas-treating body is heated after having been impregnated with a metal compound solution containing aluminum such as $Al(NO_3)_3$, or a method in which the exhaust gas-treating body is heated after having been impregnated with a solution containing alumina powder, and the like.

Moreover, as the method for supporting a catalyst on an alumina film, for example, a method may be used in which an exhaust gas-treating body on which an alumina film has been formed is impregnated with a solution containing noble metal, or the like, and then heated.

The essential features of the method of an exhaust gas purifying apparatus, and the exhaust gas purifying apparatus according to the embodiments of the present invention are formation of a gap between the first end face and the second end face of the holding sealing material having a length shorter than the circumferential length of the exhaust gas-treating body by winding the holding sealing material around the exhaust gas-treating body, and disposition of at least one of an electrode member and a sensor at the gap. By appropriately combining the various structures described in the first to the third embodiments and other embodiments of the present invention (for example, number and position of electrode member and/or sensor, kinds of sensor, size of projected portion in holding sealing materials, composition of inorganic fibers forming holding sealing materials, and the like) with the essential features, desired effects are more likely to be obtained.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of manufacturing an exhaust gas purifying apparatus, comprising:

providing an exhaust gas-treating body;

providing a holding sealing material including inorganic fibers, the holding sealing material having a mat shape with a length, a width and a thickness, the holding sealing material having a first end face and a second end face each provided approximately in parallel with a width direction, the holding sealing material having the length shorter than a circumferential length of the exhaust gas-treating body;

winding the holding sealing material around a periphery of the exhaust gas-treating body to form a gap between the first end face and the second end face of the holding sealing material;

housing the exhaust gas-treating body with the holding sealing material in a casing so that the holding sealing material is disposed between the exhaust gas-treating body and the casing;

disposing at least one of a first electrode member and a first sensor at the gap of the holding sealing material so that at least one of the first electrode member and the first sensor is connected to the exhaust gas-treating body, passes through the holding sealing material, and penetrates the casing; and disposing at least one of a second electrode member and a second sensor after winding the holding sealing material so that at least one of the second electrode member and the second sensor is connected to the exhaust gas-treating body, passes through the holding sealing material, and penetrates the casing, wherein the holding sealing material has a penetration portion penetrating the holding sealing material in a thickness direction, and at least one of the second electrode member and the second sensor is disposed at the penetration portion of the holding sealing material, and wherein a diameter of a cross section of the penetration portion of the holding sealing material is from about 1 mm to about 100 mm.

2. The method according to claim 1, wherein the length of the holding sealing material in a length direction is from about 50% to about 99.8% of the circumferential length of the exhaust gas-treating body.

3. The method according to claim 1, wherein a distance between the first end face and the second end face of the holding sealing material is from about 1 mm to about 100 mm when the holding sealing material is wound around the exhaust gas-treating body.

4. The method according to claim 1, wherein each of the first end face and the second end face of the holding sealing material has a step having at least one projected portion.

5. The method according to claim 1, wherein a number of the penetration portion is one.

6. The method according to claim 1, wherein the gap and the penetration portion face each other via the exhaust gas-treating body interposed between the gap and the penetration portion when the holding sealing material is wound around the exhaust gas-treating body.

7. The method according to claim 1, wherein a shape of the penetration portion of the holding sealing material is at least one of approximately round pillar shape, approximately rectangular-pillar shape, approximately cylindroid shape, approximately truncated cone shape, and pillar shape having a bottom face surrounded by approximately straight line and approximately arc line.

8. The method according to claim 1, wherein a distance between the first end face and the second end face is approximately a same at any part of the holding sealing material.

9. An exhaust gas purifying apparatus comprising:

a casing;

an exhaust gas-treating body housed in the casing;

a holding sealing material including inorganic fibers, the holding sealing material having a mat shape with a length, a width and a thickness, the holding sealing material having a first end face and a second end face each provided approximately in parallel with a width direction of the holding sealing material, the length of the holding sealing material being shorter than a circumferential length of the exhaust gas-treating body, the holding sealing material being wound around the exhaust gas-treating body so that the first end face and the second end face of the holding sealing material face each other, the holding sealing material being disposed between the exhaust gas-treating body and the casing; and a gap provided between the first end face and the second end face of the holding sealing material;

at least one of a first electrode member and a first sensor disposed at the gap, at least one of the first electrode member and the first sensor being connected to the exhaust gas-treating body, passing through the holding sealing material, and penetrating the casing; and at least one of a second electrode member and a second sensor connected to the exhaust gas-treating body, passing through the holding sealing material, and penetrating the casing, wherein the holding sealing material has a penetration portion penetrating the holding sealing material in a thickness direction, and at least one of the second electrode member and the second sensor is disposed at the penetration portion of the holding sealing material, and wherein a diameter of a cross section of the penetration portion of the holding sealing material is from about 1 mm to about 100 mm.

10. The exhaust gas purifying apparatus according to claim 9, wherein the length of the holding sealing material in the length direction is from about 50% to about 99.8% of the circumferential length of the exhaust gas-treating body.

11. The exhaust gas purifying apparatus according to claim 9, wherein a distance between the first end face and the second end face of the holding sealing material is from about 1 mm to about 100 mm.

12. The exhaust gas purifying apparatus according to claim 9, wherein each of the first end face and the second end face of the holding sealing material has a step having at least one projected portion.

13. The exhaust gas purifying apparatus according to claim 9, wherein a number of the penetration portion is one.

14. The exhaust gas purifying apparatus according to claim 9, wherein the gap and the penetration portion face each other via the exhaust gas-treating body interposed between the gap and the penetration portion.

15. The exhaust gas purifying apparatus according to claim 9, wherein a shape of the penetration portion of the holding sealing material is at least one of approximately round pillar shape, approximately rectangular-pillar shape, approximately cylindroid shape, approximately truncated cone shape, and pillar shape having a bottom face surrounded by approximately straight line and approximately arc line.

16. The exhaust gas purifying apparatus according to claim 9, wherein a distance between the first end face and the second end face is approximately a same at any part of the holding sealing material.

* * * * *